US012624516B2

(12) United States Patent
Clements et al.

(10) Patent No.: US 12,624,516 B2
(45) Date of Patent: May 12, 2026

(54) MODULAR NETWORK ACCESS FRAME AND COVER

(71) Applicant: CUBIS SYSTEMS LIMITED, Belfast (GB)

(72) Inventors: Claire Clements, Moira (GB); Steven Brooker, Craigavon (GB)

(73) Assignee: CUBIS SYSTEMS LIMITED, Belfast (GB)

( * ) Notice: Subject to any disclaimer, the term of this patent is extended or adjusted under 35 U.S.C. 154(b) by 611 days.

(21) Appl. No.: 18/024,954

(22) PCT Filed: Sep. 7, 2021

(86) PCT No.: PCT/GB2021/052301
§ 371 (c)(1),
(2) Date: Mar. 6, 2023

(87) PCT Pub. No.: WO2022/049401
PCT Pub. Date: Mar. 10, 2022

(65) Prior Publication Data

US 2023/0332371 A1 Oct. 19, 2023

(30) Foreign Application Priority Data

Sep. 7, 2020 (GB) ..... 2014004

(51) Int. Cl.
*E02D 29/14* (2006.01)

(52) U.S. Cl.
CPC ..... *E02D 29/1454* (2013.01)

(58) Field of Classification Search
CPC ..... E02D 29/1454
(Continued)

(56) References Cited

U.S. PATENT DOCUMENTS 1,719,151 A * 7/1929 Wathey ..... E02D 29/1418 49/389
2,056,362 A * 10/1936 Moore ..... E02D 17/10 404/25

(Continued)

FOREIGN PATENT DOCUMENTS

CN 209816927 U 12/2019
EP 0808951 A1 11/1997

(Continued)

OTHER PUBLICATIONS

GB Application No. 2014004.2; Search Report dated Mar. 16, 2021.
PCT Application No. PCT/GB2021/052301; International Search Report dated Mar. 7, 2022.

*Primary Examiner* — Raymond W Addie
(74) *Attorney, Agent, or Firm* — SCHWABE WILLIAMSON & WYATT, P.C.

(57) ABSTRACT

A modular frame for a cover for an in-ground chamber or pit, the modular frame comprising a plurality of frame sections securable relative to one another to form an external frame, at least some of the frame sections comprising an abutment wall to abut an upper portion of the in-ground chamber or pit, and a cover support structure to support a portion of one or more cover members relative thereto. Optionally, a depending structure to at least partially define an internal skirt configured to be received within the in-ground chamber or pit and/or an external upstand to at least partially define an opening into which the one or more cover members are locatable to at least partially close the opening may be provided. A cover including the modular frame and an in-ground chamber or pit including the cover are also provided.

19 Claims, 16 Drawing Sheets

(58) Field of Classification Search
USPC ..... 404/25, 26; 52/19, 20
See application file for complete search history.

(56) References Cited

U.S. PATENT DOCUMENTS 2,109,287 A * 2/1938 Elkington ..... E02D 29/14 404/25
3,999,335 A * 12/1976 Nagy ..... E04H 5/06 49/33
4,867,600 A * 9/1989 Bowman ..... E02D 29/124 404/26
4,904,120 A * 2/1990 Spiess ..... E02D 29/14 405/303
5,024,550 A * 6/1991 Mainville ..... E03F 5/06 210/163
5,039,248 A * 8/1991 Bowman ..... E02D 29/124 404/26
5,203,135 A 4/1993 Bastian
6,044,590 A * 4/2000 Gagas ..... E02D 29/1463 404/25
9,789,025 B2 * 10/2017 Henshue ..... E01C 5/20
2005/0008431 A1 1/2005 Albaugh
2010/0329782 A1 * 12/2010 Miller ..... E02D 29/14 404/25
2011/0150570 A1 * 6/2011 Pickavance ..... E02D 29/14 164/129
2019/0145079 A1 * 5/2019 De Siena ..... E02D 29/149 404/25

FOREIGN PATENT DOCUMENTS

EP 3514287 A1 7/2019
FR 671565 A 12/1929
FR 1218379 A 5/1960
GB 2394968 A 5/2004
GB 2404409 A 2/2005

* cited by examiner

MODULAR NETWORK ACCESS FRAME AND COVER

CROSS-REFERENCE TO RELATED APPLICATION

This application is a 371 U.S. National Stage of International Application No. PCT/GB2021/052301, filed Sep. 7, 2021, entitled "MODULAR NETWORK ACCESS FRAME AND COVER," which designated, among the various States, the United States of America, and which claims priority to GB 2014004.2, filed Sep. 7, 2020, all of which are hereby incorporated by reference.

TECHNICAL FIELD OF THE INVENTION

The present invention relates generally to the field of in-ground access chambers and pits. In particular, but not exclusively, the invention concerns a modular frame and cover for an in-ground access chamber or pit.

BACKGROUND TO THE INVENTION

The main components making up a complete network access system solution are the chamber, frame, beams and covers. Modular access chambers are available such as the STAKKAbox™ ULTIMA Connect. However, a modular frame and cover solution is not currently available to supply large scale applications.

Frames supplied with access covers conventionally, are bespoke, typically one piece, metal designs. A chamber size is typically selected for the purpose and the required frame/cover requirements specified.

This information is then passed to the technical team and a bespoke frame system is designed. This a one-piece frame, or in the case of large-scale chamber applications, this design will need to be split for transport and manual handling purposes.

In addition to this, certain finishing processes such as galvanising for example, can cause further issues such as warping of the frame. This can occur for example if galvanised as a single piece or in split sub-assembly situations. Warpage of split sub-assemblies can consequently lead to issues during the assembly process.

This process presents a number of issues that include but are not limited to a heavy reliance on design resource for bespoke sizes, design and supply efficiency issues due to the laborious process of bespoke solutions leading to lengthy lead times for customers, operational challenges (for example, the assembly and disassembly of the frame before and after galvanising), logistical challenges, health and safety concerns, stocking challenges and quality challenges.

Embodiments of the invention seek to at least partially overcome or ameliorate any one or more of the abovementioned disadvantages or provide the consumer with a useful or commercial choice.

SUMMARY OF THE INVENTION

According to a first aspect of the invention there is provided a modular frame for a cover for an in-ground chamber or pit, the modular frame comprising:

a plurality of frame sections securable relative to one another to form an external frame, at least some of the frame sections comprising:

i. an abutment wall to abut an upper portion of the in-ground chamber or pit;

ii. a cover support structure to support a portion of one or more cover members relative thereto; and iii. an external upstand to at least partially define an opening into which the one or more cover members are locatable to at least partially close the opening.

The modular frame may further comprise a depending structure to at least partially define an internal skirt configured to be received within the in-ground chamber or pit.

According to a second aspect of the invention there is provided a cover assembly for an in-ground chamber or pit comprising the modular frame of the first aspect and at least one cover member.

According to a third aspect of the invention there is provided an in-ground chamber or pit including at least one wall assembly and a cover comprising the modular frame of the first aspect and at least one cover member.

Providing a modular frame as defined will allow a cover to be formed for an in-ground chamber or pit utilising frame sections which are securable relative to one another to form a frame for a cover of the required size to fit an in-ground chamber or pit without requiring bespoke design. The modular frame as defined allows assembly on site. The modular frame can also be used instead of one-piece frames, minimising transport issues, particularly for larger frames.

The modular frame of the present invention is typically manufactured in dimensions which are determined according to multiples of the cover member size. This will assist with minimising the number of variant sizes of cover member that have to be manufactured. Typically, the cover member will be manufactured in a single size (although more than one standard size can be manufactured) and then the modular frame will typically be formed using one or more cover members with the modular frame dimensions determined according to how many cover members are used.

The frame sections will typically be manufactured in a number of predetermined cut lengths. The modular frame will typically be formed using the predetermined cut lengths.

The modular frame will normally include one or more straight frame sections. The straight frame sections will normally have a consistent cross-sectional shape across the length of the frame section. In an embodiment, the straight frame sections may be extruded although other methods of manufacture may be used.

The modular frame may include one or more corner frame sections. A corner frame section will typically have a pair of frame section portions at an angle to one another. Although any angle could be used, the most common shape of the modular frame will normally be rectangular and in the configuration, the corner frame sections will typically have an angle of 90° between the pair of frame section portions. The frame section portions of a corner frame sections will typically be securable relative to one another to form a corner frame sections. The frame section portions of a corner frame section may be releasably securable relative to one another. This can be achieved in any way. Providing frame section portions that are securable relative to one another to form a corner frame section will allow the corner frame section to be transported in an unassembled form requiring less space and assembled on site.

The frame section portions will preferably be mitre cut at the respective ends to form the corner frame sections. Alternatively, straight cut frame section portions may be used.

In an embodiment, the frame section portions of a corner frame sections may be extruded, although other methods of manufacture may be used. A corner frame sections may be moulded in a single piece, but again, any suitable method of manufacture may be used.

Typically, the plurality of frame sections will be manufactured to form the modular frame of the required size and the frame sections may be delivered to the site of the in-ground chamber or pit and built/assembled on site. As mentioned above, the modular frame will typically be formed from combinations of frame sections of predetermined cut lengths. The modular frame will typically be sized to fit onto an in-ground chamber or pit. Once the modular frame has been assembled, the cover members are typically fitted relative to the modular frame to form the cover assembly. The modular frame can be assembled to the chamber on or off site. The one or more cover members will usually only be applied to the modular frame after the modular frame has been fitted to the assembled chamber.

The modular frame typically includes a plurality of frame sections securable relative to one another to form an external frame. In an embodiment, the plurality of frame sections may be releasably securable relative to one another. It may be preferred however that once the frame sections are locked relative to one another, the frame is not capable of disassembly, and therefore, in some circumstances, the frame sections may not be releasably securable relative to one another.

The frame and/or cover sections can be formed of any material. Normally, a plastic or composite material will be used for low weight but high strength. The frame sections may be made of metal and some circumstances, particularly for increased strength which may be required in larger frames, or frames which cover in-ground chambers or pits of larger dimensions.

As mentioned above, the frame sections used to form the modular frame may include one or more straight frame sections and a number of corner sections to correspond to the shape of the pit. Generally, one or more connectors will be used to lock the frame sections relative to one another. In an embodiment, the connector may be a connector block. The connector block of an embodiment is preferably shaped to fit relative to respective parts of adjacent frame sections. A simple locking mechanism may be provided through the provision of a perpendicular mechanical fastener such as a pin or bolt or similar which may be located through a portion of the frame section and then through the connector block.

The connector block may be solid or hollow. The connector block may be provided with at least a pair of transverse openings to receive a locking pin, one locking pin locking the connector block to each of the pair of adjacent frame sections. A straight connector block may be provided to connect a straight frame section to a straight frame section or a straight frame section to a frame section portion of a corner frame section relative to one another. An angled connector block may be provided to connect the frame section portions of a corner frame section relative to one another.

Typically, all of the frame sections used in the modular frame will include the depending structure and the external upstand. Some frame sections may lack the depending structure, as not every frame section needs to be provided with a depending structure to allow the modular frame to be located within the opening of the in-ground chamber or pit. Preferably, all of the frame sections include an external upstand, as the external upstand is primarily responsible for maintaining the cover members in place relative to the frame, particularly against the lateral movement.

At least some of the frame sections of the modular frame will preferably include an abutment wall to abut an upper portion of the in-ground chamber or pit. In an embodiment, the abutment wall will typically be substantially horizontal when the modular frame is in use. There are circumstances where the abutment wall may not be horizontal, for example, when the in-ground chamber or pit is installed on an angle and an upper edge of the sides of an in-ground chamber or pit are oriented at an angle to match the angle of the ground in which the chamber or pit is installed.

The installation method used may require for cementitious material such as mortar to be placed between the top of the chamber and underside of the frame (abutment wall). The mortar can be used to adjust the height of the chamber/modular frame.

The abutment wall will preferably abut an upper edge of at least one side wall of the chamber or pit. Preferably, the abutment wall abuts the upper edge directly.

The abutment wall will preferably be planar.

In an embodiment, each frame section may include a central body. The abutment wall may be or include a lower wall of the central body. In the circumstance where each frame section includes a central body, the cover support structure may be provided at an upper side of the central body, spaced from the abutment wall.

The central body is preferably hollow to reduce weight but to maintain the required strength characteristics. The abutment wall and cover support structure will typically be spaced apart by a pair of end walls. The end walls will typically extend substantially perpendicularly to the abutment wall and the cover support structure to define a generally rectangular central body. The end walls may be a part of the depending structure and/or external upstand.

One or more intermediate walls (between the end walls) may be provided between the abutment wall and the cover support structure. The provision of one or more intermediate walls may define one or more internal bores within the preferred central body. The one or more intermediate walls are preferably parallel to the end walls.

The abutment wall will typically extend laterally across the width of the side wall of the in-ground chamber or pit. The abutment wall may not abut the side wall of the in-ground chamber or pit across the entire width of the side wall.

The abutment wall will preferably extend over the length of the frame section.

The abutment wall may be provided with a depending lip at an outer side thereof, preferably at an opposite side to the depending structure. The depending lip may not extend downwardly as far as the depending structure. The depending lip may assist with locating the frame section on the side wall of the in-ground chamber or pit. The depending lip may be shaped correspond to a portion of the side wall of the in-ground chamber or pit.

Typically, all frame sections will include the abutment wall. The provision of the abutment wall on all frame sections will preferably result in an abutment wall formed around the periphery of the modular frame to abut the side wall of the in-ground chamber pit about the periphery of the in-ground chamber pit. This will assist with spreading the load of the modular frame on the side wall of the in-ground chamber or pit.

Preferably, the abutment wall on adjacent frame sections will preferably be coplanar.

At least some of the frame sections of the modular frame will preferably include a cover support structure to support a portion of one or more cover members relative thereto.

More than one cover member may be supported on the cover support structure of a frame section. In an embodiment, the cover support structure will preferably be or include a cover support wall. Normally, the cover support wall will be oriented substantially horizontally in use. The cover support wall will typically be substantially parallel to the abutment wall and spaced therefrom.

The cover support structure will typically support lower portion of one or more cover members. Preferably, the cover support structure abuts an outer portion of one or more cover members. Typically, a lower portion of the one or more cover members is supported directly on the cover support structure or wall.

The cover support wall will typically be provided on the opposite side of the preferred central body of the frame section to the abutment wall. The preferred cover support wall and abutment wall will typically be parallel to one another and spaced apart. As mentioned above, this will typically define a rectangular central body.

The preferred cover support will preferably extend from an inner side of the external upstand to an inner side of the depending structure.

Typically, all frame sections will include the cover support structure in order to spread the load of the cover members to ensure that the cover members are appropriately supported by the external frame. As will be explained further below, the external frame may be provided with one or more transverse beams to support other portions of the one or more cover members.

Preferably, the cover support walls of adjacent frame sections are coplanar with one another.

At least some of the frame sections of the modular frame preferably include a depending structure to at least partially define an internal skirt configured to be received within the in-ground chamber or pit. The depending structure may have any shape. The depending structure may be shaped to correspond with a portion of the side wall of the chamber or pit. The depending structure of an embodiment may be generally rectangular in cross-sectional shape. The preferred generally rectangular depending structure will typically be hollow, formed from a number of wall portions.

The depending structure will typically extend substantially perpendicularly to the lateral abutment wall of the frame section.

The depending structure will generally depend from the preferred central body of the frame section. An inner wall of the preferred depending structure may be an extension of an inner side wall of the preferred central body. A spaced apart, outer wall may be provided in the preferred rectangular depending structure. Typically, the outer wall is parallel to the inner wall. The transverse connecting wall may be provided at a lower end of the inner wall and the outer wall of the preferred rectangular depending structure.

The depending structure is preferably provided over the length of each of the frame sections. Typically, all frame sections will have the depending structure.

The length of the frame sections chosen to form the modular frame preferably forms an internal skirt on the modular frame which is configured to centre the modular frame on the in-ground chamber or pit by being received within the one or more sidewalls of the in-ground chamber or pit which in turn, preferably secures the modular frame against lateral movement. The internal skirt preferably extends about an internal periphery of the modular frame, although it need not be continuous.

At least some of the frame sections of the modular frame preferably include an external upstand to at least partially define an opening into which the one or more cover members are locatable to at least partially close the opening. The external upstand will typically be shaped. In one form, the external upstand will typically have a substantially vertical outer wall. The outer wall will preferably be planar. The outer wall will preferably be at an outer side of the frame section with an overhang to provide clearance an external side of the frame section.

An outer extremity of the external upstand will typically be spaced further outwardly than the external wall of the preferred central body. This configuration will typically create an outer extremity of the external upstand overhanging a lower portion of the frame section which may protect the preferred central body of the frame section from any contact, for example with the side wall of a chamber in which the in-ground chamber or pit is provided. As will become clearer below, this configuration will also create clearance for other members, such as the head of a bolt provided to attach a beam pocket for example.

The external upstand may be provided with an upper wall which is spaced above the cover support structure. The upper wall will typically be spaced above the cover support structure sufficiently such that the upper wall is substantially coplanar with the top surface of one or more cover members when the one or more cover members is correctly fitted relative to the modular frame. The upper wall will preferably be substantially planar. The upper wall will typically be substantially horizontal in use.

The external upstand will preferably have an inner wall. The inner wall will typically be substantially vertical. The inner wall preferably extends downwardly from an inner end of the upper wall. The inner wall will typically be the portion of the upstand which at least partially defines the opening for the cover member. The inner wall will also typically provide an abutment wall for the edge of the cover member, should the cover member be forced laterally within the modular frame at any time. When the one or more cover members are fitted relative to the modular frame, a clearance or separation gap will typically be provided between the inner wall of the frame section and the outer edge of the cover member located adjacent thereto. In a preferred form, the cover member will be spaced from the inner wall (and from other cover members) by a fixed dimension, preferably on both (and/or all) sides. In use, the cover members will preferably be provided relative to the modular frame using a fixed dimension peripheral clearance or separation gap about each cover member.

A flange preferably extends transversely and inwardly from the preferred inner wall of the external upstand. The flange will typically function as a locking ledge to releasably lock one or more cover members relative thereto. Typically, the locking ledge will extend over the length of the frame section. In one possible configuration, the or each cover member may have a stepped outer edge with a peripheral upper lip extending further outwardly than a lower part of the cover member. The locking ledge will also preferably support the peripheral upper lip of the cover member thereon. The lower part of the cover member will typically be supported on the cover support structure.

The flange or locking ledge may also be used to engage a locking mechanism or structure provided on or relative to the or each cover member. This will typically assist with maintaining the cover members relative to the modular frame against vertical movement. For example, a laterally extending deformable cover attachment member may be provided on the cover member and when the cover member is installed relative to the modular frame, the deformable cover attachment member may abut an underside of the flange. As will be explained below, the cover member may be provided with one or more rotatable locking members.

The flange will typically be spaced from the upper terminus of the external upstand and from the cover support structure. Normally, the flange will be located approximately halfway between the upper wall of the external upstand and the preferred cover support wall.

The cover assembly for an in-ground chamber or pit will typically include more than one cover member located relative to the modular frame. As mentioned above, the number of cover members used will typically be a whole number (in other words, cover members will not be required to be cut to fit to the modular frame). The cover members may have different dimensions, for example, half size cover members may be provided in order to maximise the configurations available, but the cover members will preferably all have the same features, allowing cover members of different dimensions to be fitted relative to the modular frame in any location.

Each cover member will typically have a substantially planar upper support surface. The upper support surface may have gripping members or assemblies provided relative thereto. Each cover member will preferably have a stepped side wall with a peripheral upper lip extending further outwardly than a lower part of the cover member. The peripheral upper lip will typically extend completely about the cover member.

At least one, and preferably a pair of locking members may be provided relative to each cover member to releasably lock the cover member relative to the modular frame. More than two locking members may be provided. Each locking member will typically be rotatable between a locked position and an unlocked position. In the locked position, a portion of the locking member will preferably engage the preferred locking ledge of one of the frame sections and/or a beam (explained further below). The provision of a pair of locking pins will allow the cover member to be locked in position on two sides.

In an embodiment, the locking pin will typically include an enlarged head, typically received within a rebate or recess in an upper surface of the cover member. An elongate shaft preferably extends through an opening in the cover member. A locking flange may be provided relative to the shaft which, when rotated into the locked position, typically abuts the locking ledge of the frame member and/or beam. Normally, the locking member is rotated at least approximately 90° to lock and unlock the locking member.

Each cover member will typically be a fixed depth. The cover members will normally have the same configuration. Each cover member is typically provided in a fixed depth, with a load class for the at least one cover member established via at least one material used to form the at least one cover member. Different cover members may be manufactured of different materials to adjust the load rating of the cover member to suit different load applications. For example, a lighter weight plastic may be used for a cover member with a lower load rating and a metal cover member, having the same features could be used for a higher load rating. The cover members of the lighter weight plastic and the metal cover member may be used in relation to the same frame section with the material used for the cover member adjusting the use characteristics.

The at least one cover member is dimensioned to fit in the opening with clearance on at least two sides thereof. Preferably, the clearance is provided on all four sides of the preferred rectangular cover member. This will allow the cover member to be repositioned as needed to take advantage of the clearance available.

The modular frame may be provided with one or more transverse beams to support an edge of one or more cover members. The one or more transverse beams will typically be provided between opposite sides of the modular frame. Each one or more transverse beams is preferably provided in a different dimension to achieve a required load class.

A beam pocket will typically be provided at both ends of each transverse beam to locate and support the transverse beam relative to the modular frame. The beam pocket will typically be attached to the frame section. Preferably, the beam pocket will be attached to the frame section using a releasable fastener such as an elongate bolt or similar. Where provided, the elongate bolt will typically extend laterally through the preferred central body of the frame section. Each beam pocket may be attached to a straight frame section. As mentioned above, where a bolt is provided, the head of the bolt will typically be protected by the external upstand such that the head of the bolt does not extend further laterally outside the external upstand. Each beam pocket is typically fully integrated with the modular frame to ensure effective load dispersion along the frame section.

The beam pocket will typically be substantially rectangular. Each beam pocket may be substantially rectangular comprising a transversely extending base flange and a pair of spaced apart side flanges extending transversely from or relative to the base wall to define a substantially U-shaped receiver portion into which an end of the transverse beam is received. The beam pocket will normally include a planar rear wall which is typically oriented substantially vertically in use. The transversely extending base flange will preferably extend from or relative to the planar rear wall. The base flange will typically abut a lower end portion of the beam. The side flanges will preferably extend transversely from or relative to the base wall. The beam pocket may be formed from a single piece of material which is bent or shaped to provide of the rear wall, base flange, and side flanges. One or more reinforcing sections may be provided relative to the base flange and each of the side flanges.

One or more attachment flanges may be provided relative to the planar rear wall. The attachment flanges will typically extend from the rear wall, on either side of the beam pocket to provide fixing portions through which the preferred bolts are provided to attach the beam pocket relative to the frame section(s).

Each beam pocket preferably comprises a pair of attachment flanges, one attachment flange extending laterally outside the beam pocket on either side to provide fixing portions to attach the beam pocket relative to the frame section.

Each beam will typically include a cover support structure. Typically, the cover support structure is or includes a substantially planar cover support wall. A pair of cover support walls may be provided on either side of a central divider extending over the length of the beam. The central divider will typically assist with location of a cover member relative to the beam.

The beam may be attached to the beam pocket if required or simply be received within the beam pocket to locate the beam relative to the external frame.

According to a fourth aspect, there is provided a connector block for connecting adjacent hollow frame portions together, the respective frame portions each having at least one opening in a side wall thereof to receive an elongate fastener therethrough, the connector block comprising:

a) A first connector block component comprising a body with a clamping portion, at least a pair of guide openings for a respective elongate fastener and at least one angled ramp portion;

b) A second connector block component comprising a body with a clamping portion, at least a pair of engagement openings for a respective elongate fastener and at least one angled ramp portion;

wherein elongate fasteners cause the respective angled ramp portions to slide relative to one another to move the respective clamping portions between a relaxed condition and an enlarged, clamping condition.

The connector block will preferably be located with one end within a frame portion and an opposite end within an adjacent frame portion with the respective ends of the frame portions abutting so that the connector block is wholly within the two adjacent frame portions.

The connector block will generally clamp the adjacent frame portions together by frictionally engaging with both frame portions.

The connector block of an embodiment functions by enlarging in at least one direction to engage with at least one, and preferably multiple internal surfaces of the frame portion. More than one surface or structure of the connector block may therefore be a clamping portion if it is moveable (or relatively movable) to abut an internal surface in the enlarged, clamping condition.

The frame portions may be provided with at least one opening in a side wall thereof to receive an elongate fastener therethrough. The provision of the at least one opening will generally allow the engagement and disengagement of the connector block from outside the frame portions. The at least one opening in the frame portions may assist with retaining or positioning the connector block in position, particularly when in the relaxed condition.

The elongate fasteners preferred for use will include an enlarged head and an elongate shank. The elongate shank will normally be at least partially threaded to engage with a correspondingly internally threaded portion of the engagement openings of the second connector block component.

The head of the fastener(s) usually abuts an external surface of the frame portion to tighten against the frame portion and pull the second connector block component toward the head of the fastener. The first connector block component will normally be between the second connector block component and the head of the fastener and so when the fastener is tightened, this will draw the second connector block component such that the ramp portion of the second connector block component will slide against the ramp portion of the first connector portion to expand the connector block in at least one direction to clamp against one or more internal surfaces of the frame portions.

The connector block may include a first connector block component comprising a body with a clamping portion, at least a pair of guide openings for a respective elongate fastener and at least one angled ramp portion.

The first connector block component may be provided in a single piece but could be multipiece to take advantage of different advantageous material properties. The first connector block component may be generally rectangular in shape.

The first connector block component may include an enlarged body portion located adjacent to the head of the fastener and a second portion extending substantially perpendicularly thereto. The enlarged body portion may be shaped to engage with one or more features of an internal shape of the frame portion. The enlarged body portion may positively locate the first connector block component within the frame portion.

The guide openings will normally extend through the enlarged body portion. The clamping portion will normally be provided on the second portion extending substantially perpendicularly to the enlarged body portion.

The guide openings will usually extend substantially parallel to the clamping portion. At least two guide openings may be provided.

The clamping portion may be provided on the upper or lower part of the first connector block component. The clamping portion may be provided on the other of the upper or lower part of the second connector block component with the respective ramp portions therebetween.

The clamping portion may be or include one or more structures, or surfaces or configurations. In one form, the clamping portion may be or include at least one surface. The at least one surface may have a high co-efficient of static friction. One, larger elongate surface may be provided.

A number of smaller fingers may be provided, each with a surface, and the surfaces being coplanar with each other. The provision of a number of smaller surfaces rather than a single larger surface may minimise or prevent sticking of the surface(s) to the internal surface of the frame portion against which the surfaces are clamped which may occur through prolonged clamping and/or high force clamping. However, this sticking may in some circumstances be beneficial.

If number of smaller fingers may be provided, each with a coplanar surface are provided, the fingers may be parallel although a pattern may be used in which the fingers are not parallel.

The first connector block component may include at least one angled ramp portion. More than one angled ramp portion may be provided. If more than one angled ramp portion is provided, the more than one angled ramp portions will all be aligned. If more than one angled ramp portion is provided, the more than one angled ramp portions will all be coplanar. More than one angled surface may be provided at different levels to provide different degrees of enlargement. For example, a shallow angled ramped surface may be used for initial enlargement and a steeper angle after that it the initial engagement does not lead to clamping (or vice versa).

A main angled ramp portion may be provided. The main angled ramp portion on the first connector block component may be a male portion. The main angled ramp portion may be centrally located on the first connector block component. The main angled ramp portion may be provided between the guide openings. The main angled ramp portion may be provided on the opposite side of the enlarged body to the preferred alignment boss. The main angled ramp portion will normally face the second connector block component.

One or more secondary angled clamp portions may be provided. If provided, the secondary angled ramp portion(s) on the first connector block component may be a male portion. In one embodiment, a secondary angled ramp portion may be provided at each end of the first connector block component. A guide block opening may be defined between the main angled ramp portion and an end wall relative to which each of the secondary angled ramp portions are provided.

The main angled ramp portion and the end walls of each of the secondary angled ramp portions will preferably have parallel side walls to define the guide block opening. The base of the guide block opening is also preferably planar. The base of the guide block opening will normally be perpendicular to the sidewalls of the guide block opening and an end wall of the guide block opening to guide movement of the guide blocks of the second connector block component (described further below).

A lug may be provided on each end of the first connector block component. Each lug may extend outwardly from each end wall. A groove or groove portion may be provided at least partially about an outer part of the lug. A secondary angled ramp portion may be provided on a facing side of each lug. The groove or groove portion may preferably seat a resilient loop. The resilient loop may hold the first connector block component and the second connector block component together but still allow relative movement. The resilient loop may bias the first connector block component and the second connector block component into the relaxed condition.

One or more alignment bosses or protrusions may be provided on an external side of the enlarged body portion. The one or more alignment bosses or protrusions may be provided on the same wall of the enlarged body portion as the guide openings. One or more corresponding openings or opening portions may be provided in the facing wall of the frame portion.

The one or more alignment bosses or protrusions may have any shape. A symmetrical shape such as circular or square may allow the connection block to be used in an inverted orientation if desired. An asymmetrical shape such as triangular or rectangular could be used to restrict the orientation of the connector block to a single orientation.

The connector block may include a second connector block component comprising a body with a clamping portion, at least a pair of engagement openings for a respective elongate fastener and at least one angled ramp portion.

The second connector block component preferably corresponds, at least on the facing surfaces, with the configuration of the first connector block component. There are preferably some important differences.

One or more alignment bosses may or may not be provided on the second connector block component.

The main angled ramp portion provided on the second connector block component may be a female portion (although the locations of the male and female angled ramp portions may be reversed). The female main angled ramp portion may be provided in a receiving gap on the second connector block component to receive the male main angled ramp portion provided on the first connector block component.

A lug may extend outwardly from each end wall of a guide block. A secondary angled ramp portion may be provided on each lug.

The receiving gap on the second main angled ramp portion may be flanked by a guide block on either side. Each guide block will preferably have the at least one engagement opening formed thereinto.

Each of the guide blocks will normally be received into the respective guide block opening on the first connector block component. At least a part of the outer shape of the guide blocks will normally correspond with the shape of the guide block opening. The guide blocks are each preferably rectangular in outer shape, having a planar lower wall and a pair of parallel side walls. The guide block is normally sized to be received closely within the guide block opening of the first connector block component to guide movement of the respective connector block components relative to one another.

In use, the connector block is located partially in the hollow end of a frame portion and partially in a hollow end of an adjacent frame portion. The frame portions are then pushed together until their respective end edges abut, completely containing the connector block. The fasteners can then be inserted through the openings in the frame portions, through the guide openings in the first connector block component and into the engagement openings in the second connector block component. When the fasteners are tightened, this draws the second connector block component towards the first connector block component and the respective ramp portions cause the connector block to become enlarged toward and eventually into the enlarged clamping condition in which the clamping portions abut one or more inside wall surfaces of the respective frame portions to clamp them together. Loosening the fasteners may allow the biasing force of the resilient loops to return the connector block components to the relaxed condition.

The connector block of the fourth aspect may be used to connect adjacent hollow frame portions of a modular frame according of the first aspect or be used in the cover assembly of the second aspect or the in-ground chamber or pit of the third aspect.

DETAILED DESCRIPTION OF THE INVENTION

In order that the invention may be more clearly understood one or more embodiments thereof will now be described, by way of example only, with reference to the accompanying drawings, of which:

Figure 1:
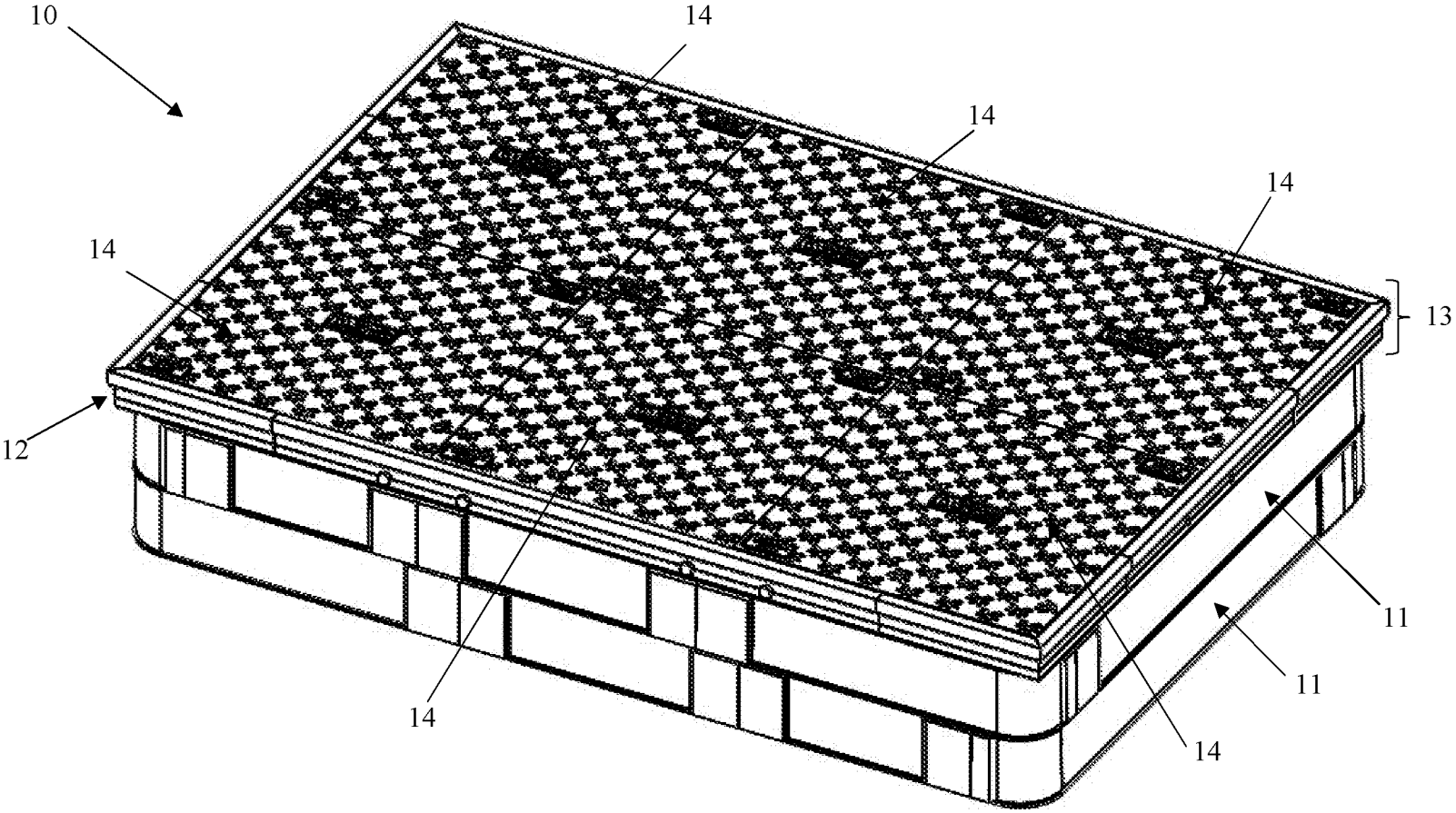
FIG. 1 is an axonometric view of a modular frame and cover of an embodiment.

With reference to the accompanying figures, a modular frame 12 for a cover 13 for an in-ground chamber or pit 10 is provided. An example of a chamber or pit 10 formed from a pair or stackable sections 11 (more could be used) is illustrated in FIG. 1 with a cover 13 formed using a modular frame 12 located thereon. The cover 13 shown in FIG. 1 is formed from 6 cover members or tiles 14 mounted relative to a modular frame 12.

The modular frame has the potential to be fitted to precast or cast-in situ concrete chambers.

Figure 2:
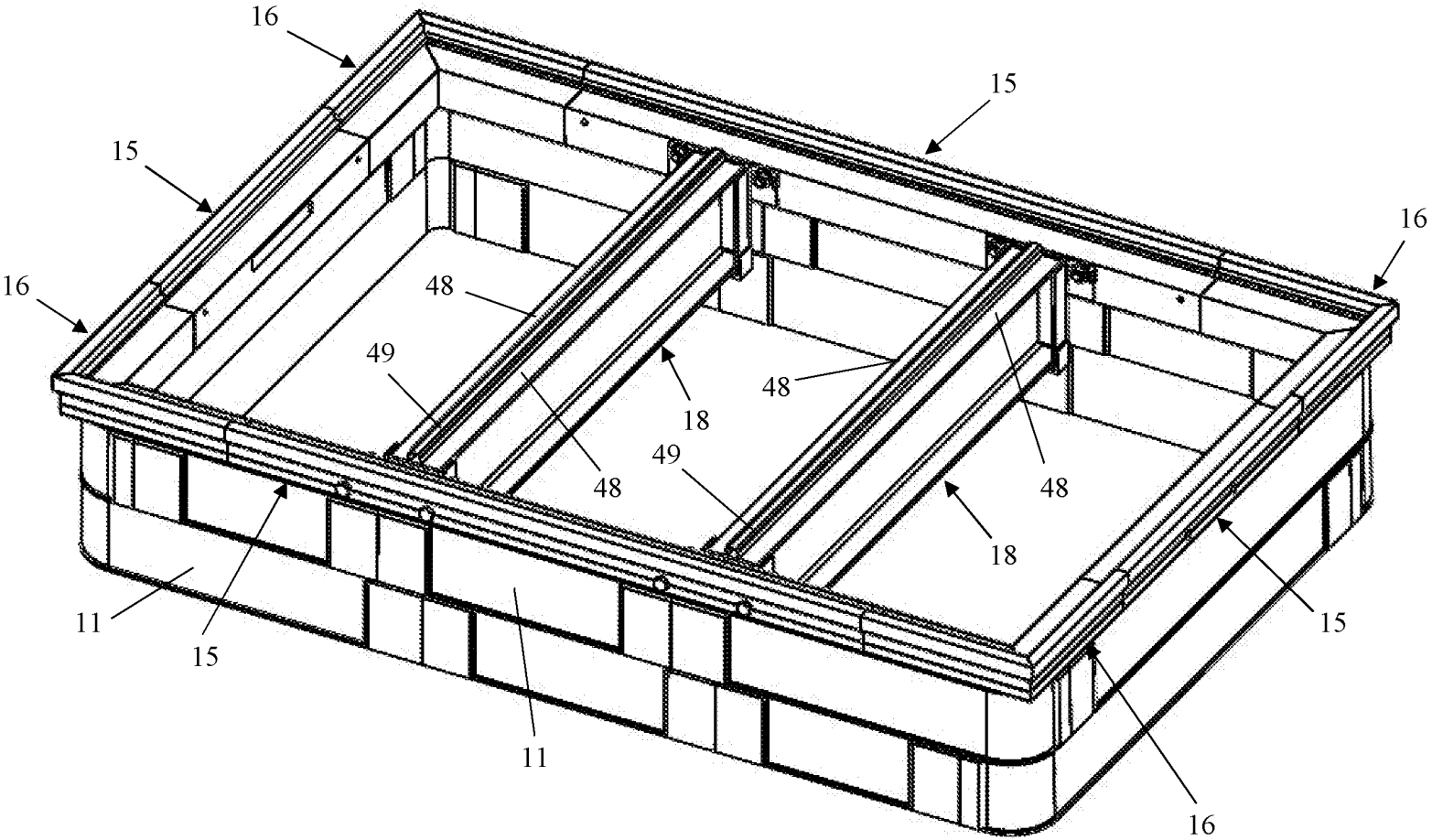
FIG. 2 is an axonometric view of a modular frame of the embodiment illustrated in FIG. 1 without the cover tiles.

The modular frame 12 is better seen in FIG. 2 as the cover members or tiles 14 have been removed. The modular frame of the illustrated embodiments comprises a plurality of frame sections securable relative to one another to form an external frame as shown in FIG. 2. The modular frame in FIG. 2 also includes two transverse beams 18 (described further below).

The modular frame 12 is typically manufactured in dimensions which are determined according to multiples of the cover member 14 size. This will assist with minimising the number of variant sizes of cover member that have to be manufactured. Typically, the cover member 14 will be manufactured in a single size (although more than one standard size can be manufactured) and then the modular frame will typically be formed using one or more cover members 14 with the modular frame dimensions determined according to how many cover members 14 are used.

Figure 3:
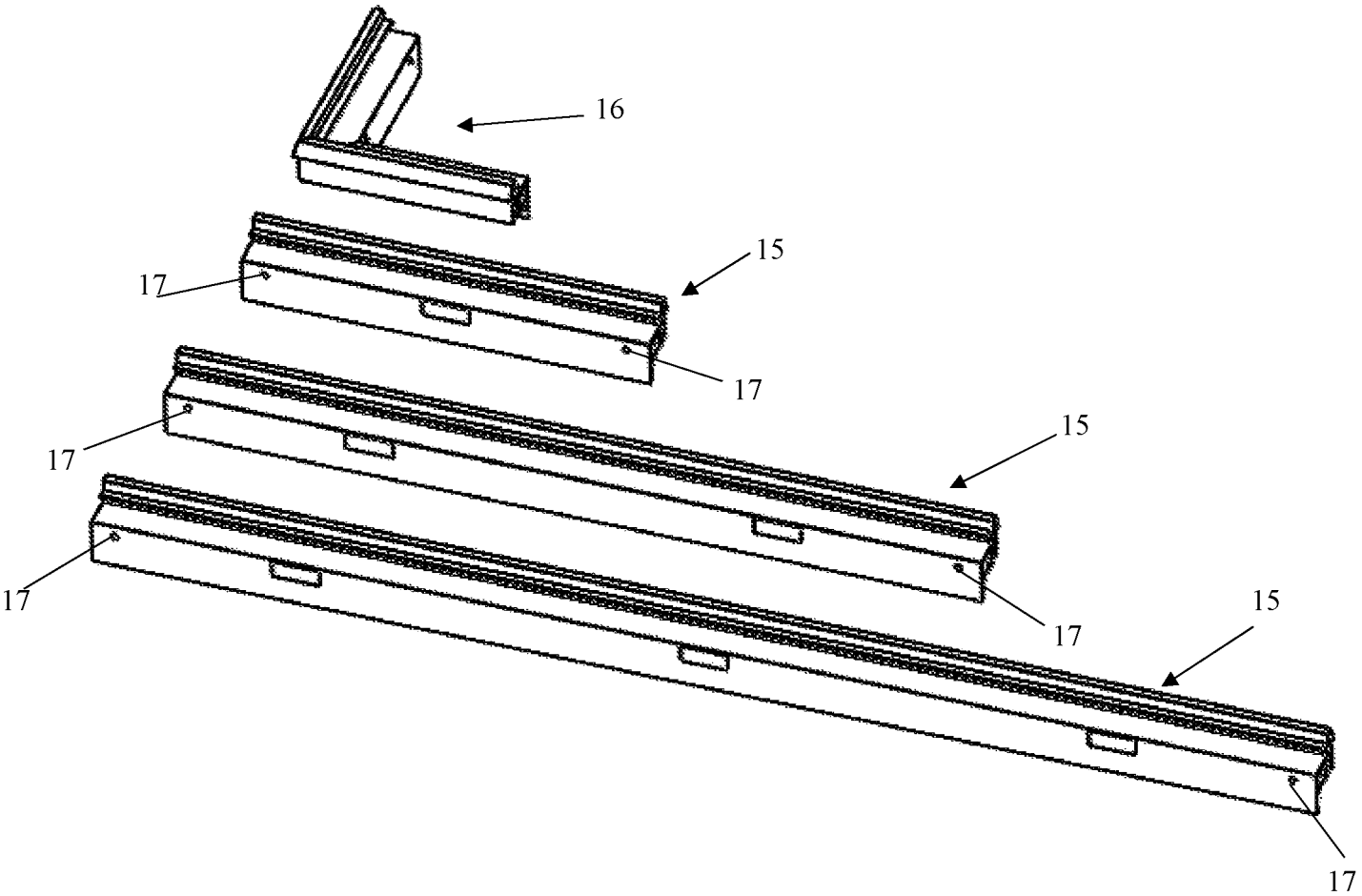
FIG. 3 is an axonometric view of a range of set length frame members according to an embodiment.

The frame sections will typically be manufactured in a number of predetermined cut lengths as shown in principle in FIG. 3.

The modular frame illustrated in FIGS. 1 and 2 includes a number of straight frame sections 15. The straight frame sections 15 will normally have a consistent cross-sectional shape over the entire length of the frame section. In an embodiment, the straight frame sections may be extruded although other methods of manufacture may be used. An attachment opening 17 is provided at both ends of the straight frame sections 15 to allow the frame sections 15 to be locked relative to an adjacent frame section. The locking arrangement is discussed below in relation to FIGS. 15 and 16.

The modular frame illustrated in FIGS. 1 and 2 includes four corner frame sections 16. As illustrated, each corner frame section 16 (illustrated in more detail in FIGS. 3 and 16) includes a pair of frame section portions 19 at an angle to one another. Although any angle could be used, the most common shape of the modular frame will normally be rectangular as shown, and in that configuration, the corner frame sections have an angle of 90° between the pair of frame section portions 19.

Figure 16:
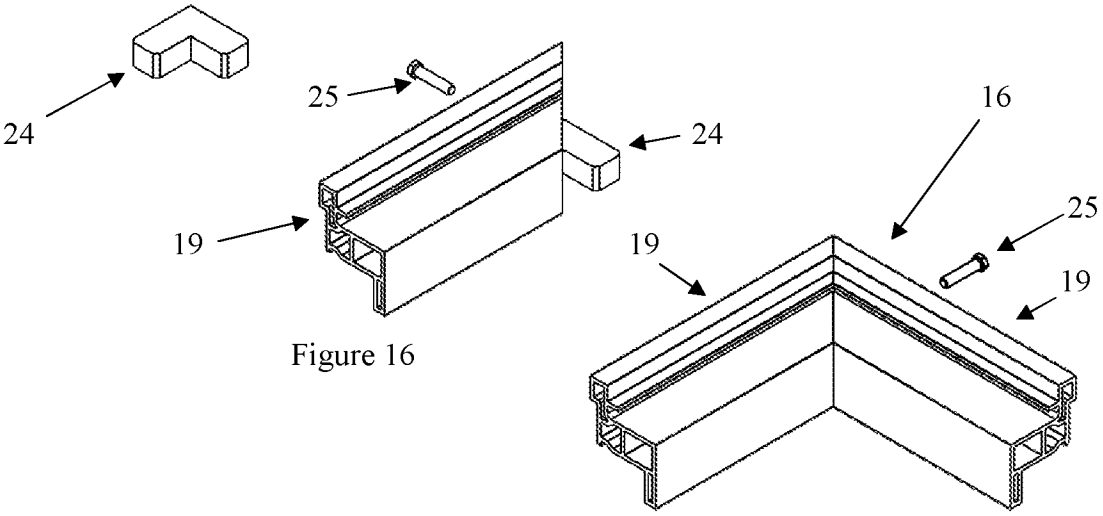
FIG. 16 is an exploded view showing attachment of the corner frame members together in an embodiment.

As shown in FIG. 16, the frame section portions 19 of a corner frame section 16 are securable relative to one another to form a corner frame section 16. The frame section portions 19 are mitre cut at the respective ends in order to form the corner frame section 16. In an embodiment, the frame section portions of a corner frame section may be extruded, although other methods of manufacture may be used.

Typically, the plurality of frame sections will be manufactured to form the modular frame of the required size and the frame sections may be delivered to the site of the in-ground chamber or pit 10 and built/assembled on site. As mentioned above, the modular frame 12 will typically be formed from combinations of frame sections of predetermined cut lengths. The modular frame 12 will typically be sized to fit onto an in-ground chamber or pit 10. Once the modular frame 12 has been assembled, the cover members 14 are typically fitted relative to the modular frame 12 in order to form the cover assembly 13. The cover assembly 13 may be formed on the in-ground chamber or pit 10, or adjacent thereto and then simply placed onto the in-ground chamber or pit 10.

Figure 5:
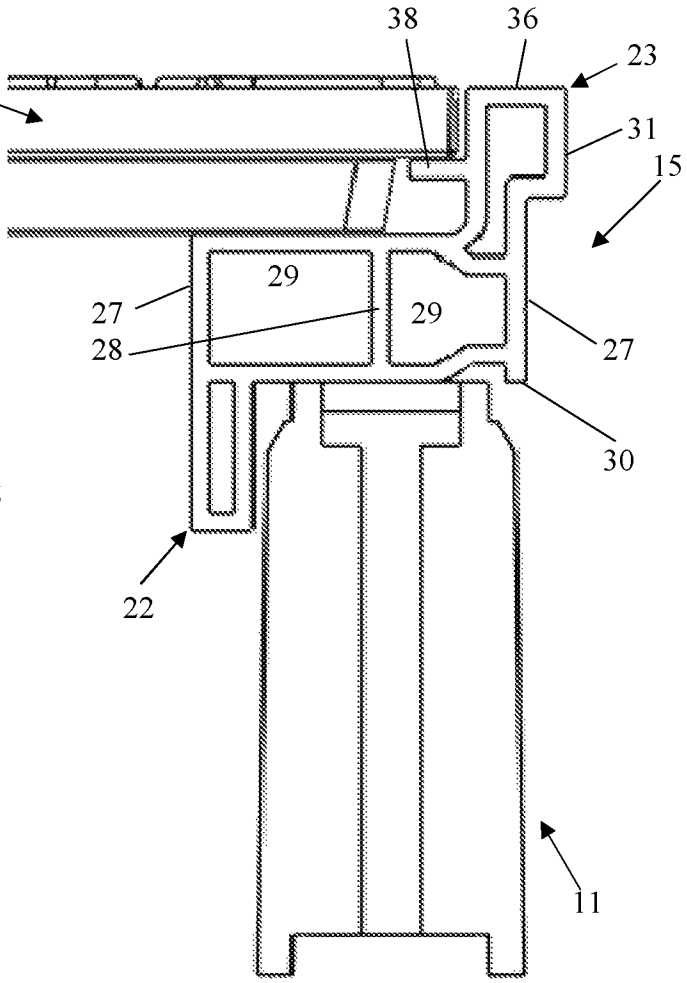
FIG. 5 is an end view of the configuration illustrated in FIG. 4.
Figure 4:
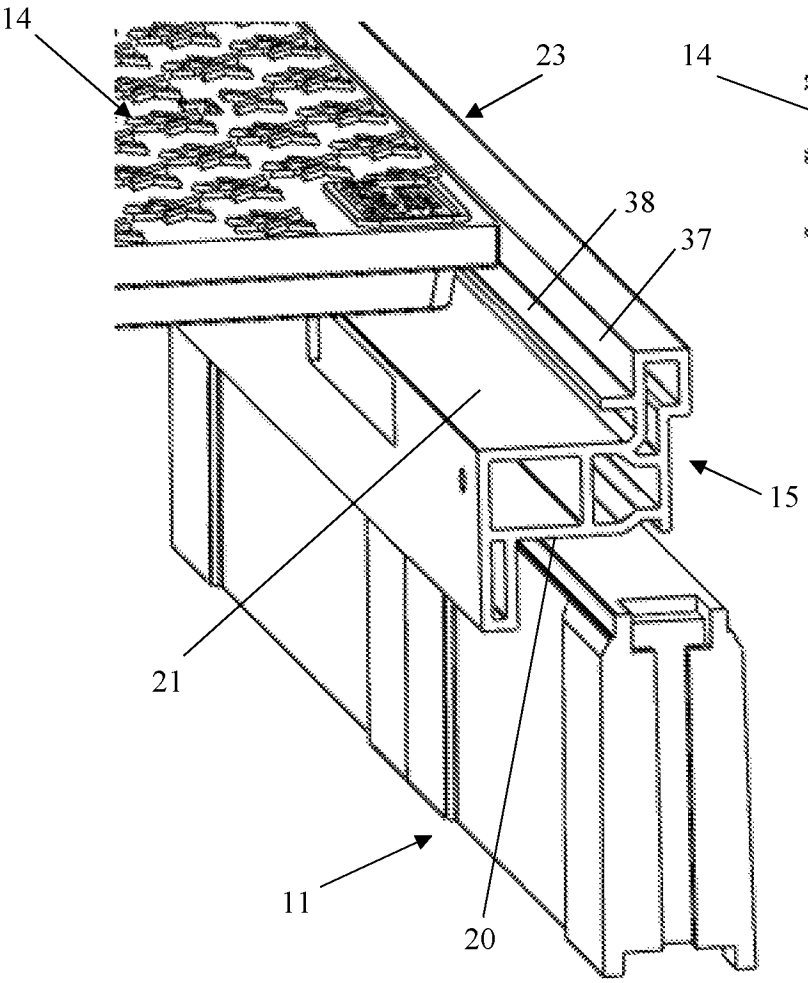
FIG. 4 is an isometric view of a sidewall of an access chamber wall, with the frame and cover of an embodiment.
Figure 6:
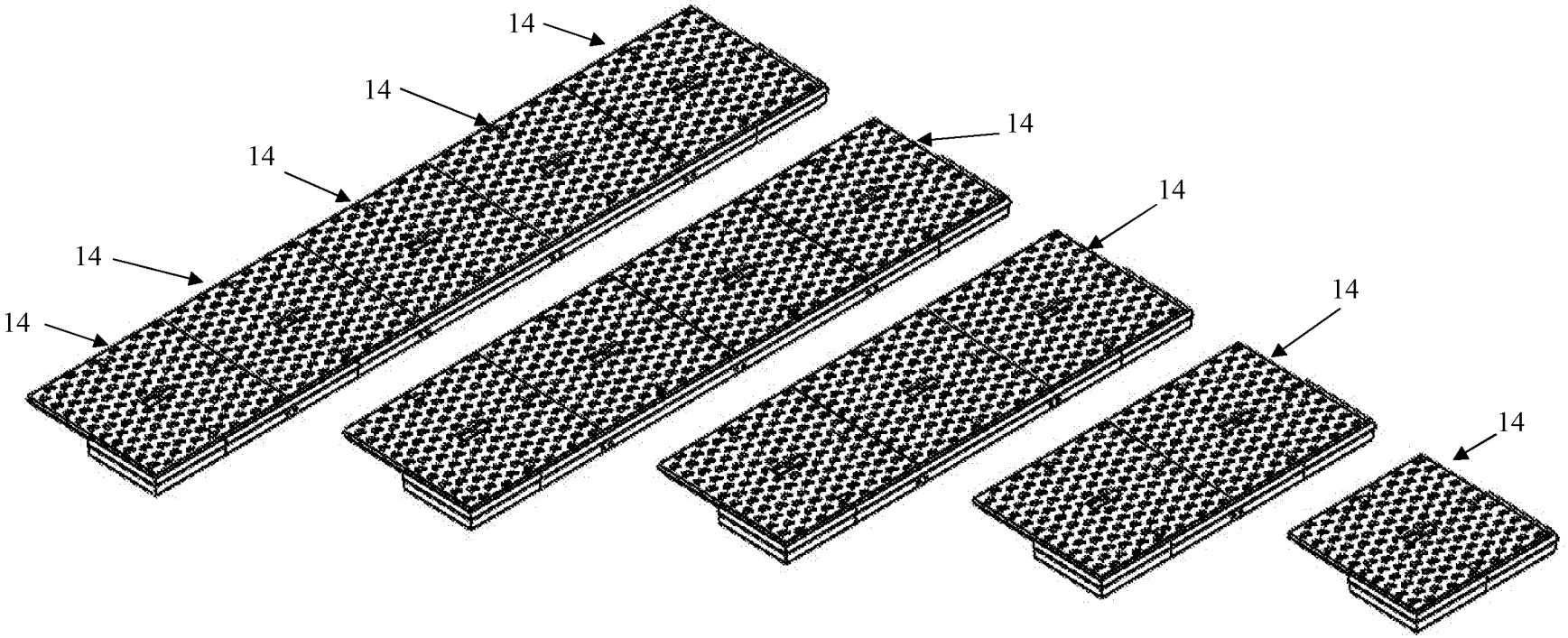
FIG. 6 is an axonometric view of a range of cover tile configurations according to an embodiment.

As illustrated in FIGS. 4 and 5, each frame section (whether a straight frame section 15 or a corner frame section 16) comprises an abutment wall 20 to abut an upper portion of the in-ground chamber or pit. Also shown in FIGS. 4 and 5 is a cover support wall 21 to support a portion of one or more cover members 14 relative to the frame section. The frame section shown in FIGS. 4 and 5 also includes a depending structure 22 to at least partially define an internal skirt configured to be received within the in-ground chamber or pit and an external upstand 23 to at least partially define an opening into which the one or more cover members 14 are locatable to at least partially close the opening in the modular frame.

Figure 15:
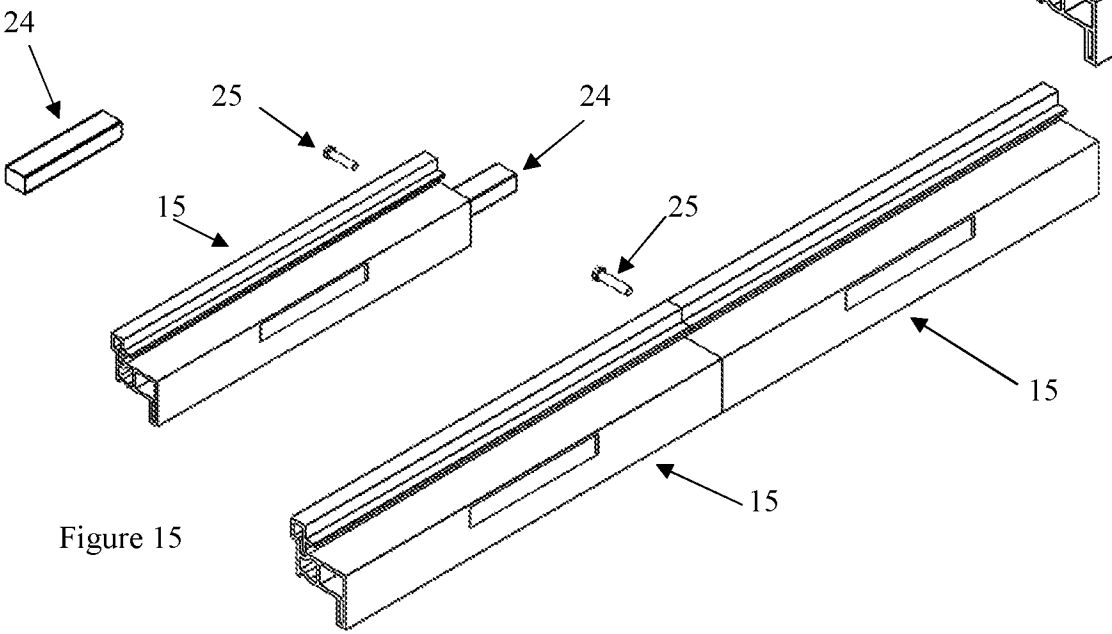
FIG. 15 is an exploded view showing attachment of the side frame members together in an embodiment.

The modular frame 12 of the illustrated embodiment includes a plurality of frame sections securable relative to one another as shown in FIGS. 15 and 16 to form an external frame 12. In an embodiment, the plurality of frame sections 15, 16 are releasably securable relative to one another.

The frame sections can be formed of any material. Normally a plastic or composite material will be used for low weight but high strength. The frame sections may be made of metal and some circumstances, particularly for increased strength which may be required in larger frames or frames which cover in-ground chambers or pits of larger dimensions.

As mentioned above, the frame sections used to form the modular frame will normally include one or more straight frame sections 15 per side and four corner sections 16. As shown in FIGS. 15 and 16, a connector block 24 can be used to lock the frame sections relative to one another. The connector block illustrated in FIGS. 15 and 16 is shaped to fit relative to respective parts of adjacent frame sections. A simple locking mechanism can be provided through the provision of a perpendicular pin 25 which is located through an opening 51 in a portion of the respective frame section and then through the connector block 25. Typically, the connector block 24 will be solid and provided with at least a pair of transverse openings to receive a locking pin 25, one locking pin 25 locking the connector block 24 to each of the pair of adjacent frame sections. A straight connector block 25 is provided to connect a straight frame section 15 to a straight frame section 15 as shown in FIG. 15 or a straight frame section 15 to a frame section portion 19 of a corner frame section 16 relative to one another. An angled connector block 25 may be provided to connect the frame section portions 19 of a corner frame section 16 relative to one another as shown in FIG. 16.

Typically, all of the frame sections 15, 16 used in the modular frame 12 include the depending structure 22 and the external upstand 23, particularly as the external upstand 23 is primarily responsible for maintaining the cover members 14 in place relative to the frame 12, particularly against any lateral movement.

In the illustrated embodiment, the abutment wall 20 is substantially horizontal when the modular frame 12 is in use. As shown in FIGS. 4 and 5, the abutment wall 20 will preferably abut an upper edge of the side wall of the chamber or pit, which in the embodiment shown, is formed from a number of stackable sections 11. Preferably, the abutment wall 20 abuts the upper edge directly.

The abutment wall illustrated is primarily planar.

In the illustrated embodiment, each frame section 15, 16 includes a central body 26 and the abutment wall 20 is configured as a lower wall of the central body 26. Where each frame section includes a central body 26, the cover support wall 21 is provided at an upper side of the central body 26, spaced from the abutment wall 20. The central body 26 is preferably hollow in order to reduce weight but maintain the required strength characteristics. The abutment wall 20 and cover support wall 21 are spaced apart by a pair of end walls 27. The end walls will typically extend substantially perpendicularly to the abutment wall 20 and the cover support wall 21 to define a generally rectangular central body. The end wall on an inner side of the body 26 extends to become the inner wall of the depending structure 22 and the end wall on an outer side of the body 26 extends to become a lower part of the external upstand 23.

An intermediate wall 28 (between the end walls 27) is provided between the abutment wall 20 and the cover support wall 21 in the embodiment shown in FIGS. 4 and 5. The provision of the intermediate wall 28 defined a pair of internal bores 29 within the central body 26 and one of these bores will receive a portion of the connector block 24.

The abutment wall 20 extends laterally across the width of the side wall 11 of the in-ground chamber or pit 10. The abutment wall 20 may not abut the side wall across the entire width of the side wall as is illustrated in FIG. 5.

The abutment wall 20 will preferably extend over the length of the frame section 15, 16.

The abutment wall 20 shown in the Figures is provided with a depending lip 30 at an outer side thereof, at an opposite side to the depending structure 22. The depending lip 30 may not extend downwardly as far as the depending structure 22. The depending lip 30 may assist with locating the frame section on the side wall of the in-ground chamber or pit 10, but the depending structure 22 will primarily locate the frame section on the side wall.

The provision of the abutment wall 20 on all frame sections 15, 16 will preferably result in an abutment wall 20 formed around the periphery of the modular frame 12 to abut the side wall about the periphery of the in-ground chamber pit 10. This will assist with spreading the load of the modular frame 12 on the side wall of the in-ground chamber or pit 10.

Preferably, the abutment walls 20 on adjacent frame sections are preferably coplanar when the frame 12 is assembled.

The frame sections 15, 16 of the modular frame 12 each preferably include a cover support wall 21 to support a portion of one or more cover members 14 relative thereto. More than one cover member 14 may be supported on the cover support wall 21 of a frame section. Normally, the cover support wall 21 is oriented substantially horizontally in use. The cover support wall 21 will typically be substantially parallel to the abutment wall 20 and spaced therefrom as discussed above.

The cover support wall 21 will typically support lower portion of one or more cover members 14 as shown in FIG. 5 in particular. Preferably, the cover support wall 21 supports an outer portion of one or more cover members 14 directly on the cover support wall 21.

The cover support wall 21 preferably extends from an inner side of the external upstand 23 to an inner side of the depending structure 22.

Typically, all frame sections will include the cover support wall 21 to spread the load of the cover members 14 to ensure that the cover member 14 are appropriately supported by the external frame 12. As will be explained further below, the external frame 12 may be provided with one or more transverse beams 18 to support other portions of the one or more cover members 14.

Preferably, the cover support walls 21 of adjacent frame sections 15, 16 are coplanar with one another when the frame is assembled.

The depending structure 22 may have any shape. The depending structure 22 of the illustrated embodiment is rectangular. The illustrated generally rectangular depending structure 22 is hollow, formed from a number of wall portions.

The depending structure 22 illustrated extends substantially perpendicularly to the abutment wall 20 of the frame section, depending from the central body 26 of the frame section. An inner wall of the depending structure 22 is an extension of the inner end wall 27 of the central body 26. A spaced apart, outer wall is provided in the preferred rectangular depending structure 22. The outer wall is parallel to the inner wall. In use, it will be the outer wall of the depending structure 22 that will abut the pit wall if there is any lateral movement of the frame or cover relative to the pit. A transverse connecting wall may be provided at a lower end of the inner wall and the outer wall of the preferred rectangular depending structure 22.

The depending structure 22 is preferably provided over the length of each of the frame sections. Typically, all frame sections will have the depending structure 22.

The length of the frame sections 15, 16 chosen to form the modular frame 12, preferably form an internal skirt on the modular frame 12 which is configured to centre the modular frame 12 on the in-ground chamber or pit 10 by being received within the one or more sidewalls of the in-ground chamber or pit 10 which in turn, preferably secures the modular frame 12 against lateral movement.

The external upstand 23 is typically shaped. In one form, the external upstand 23 will typically have a substantially vertical outer wall 31. The outer wall 31 will preferably be planar.

Figures 12, 13:
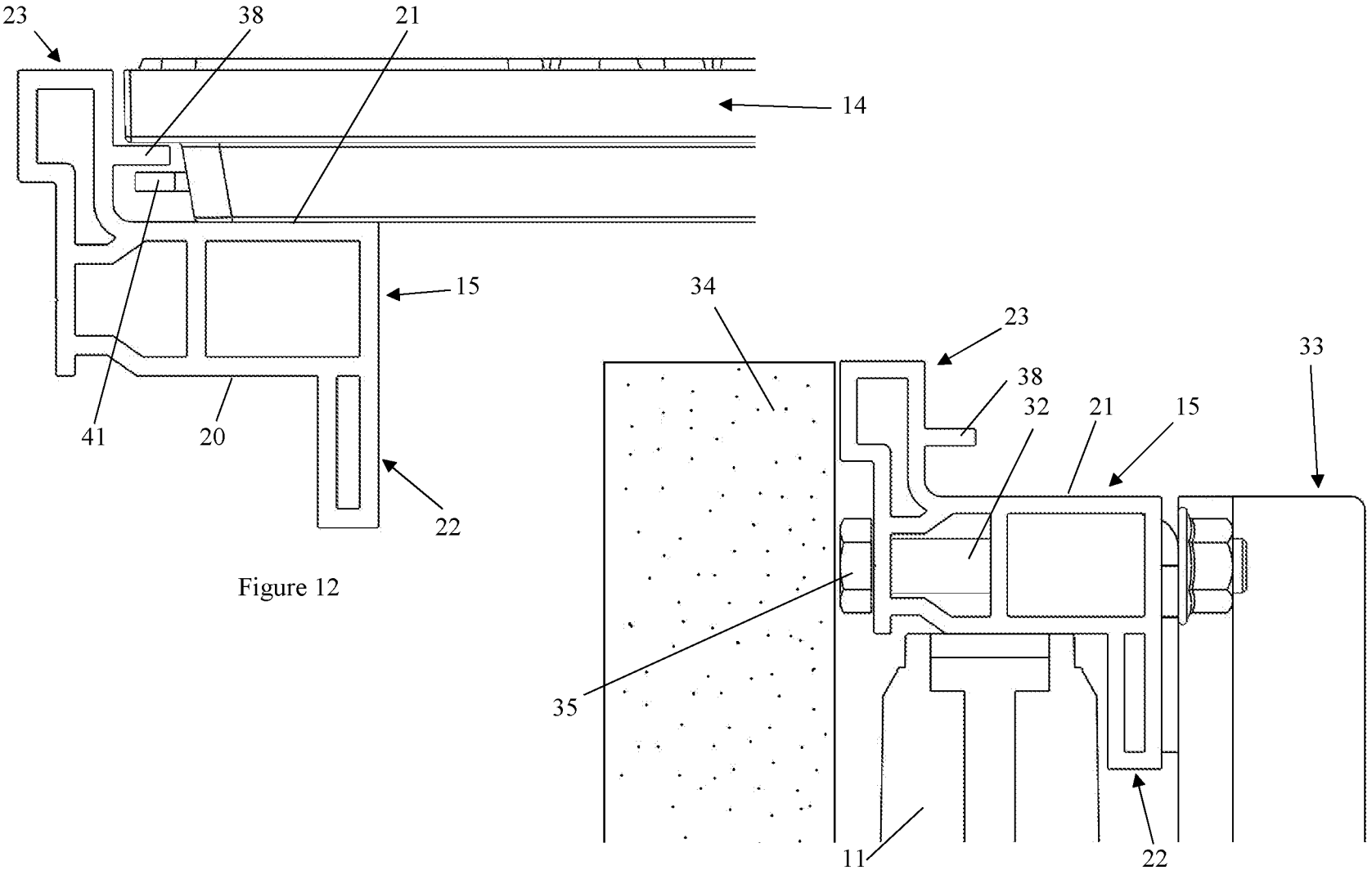
FIG. 12 is a sectional end view of the frame and cover of an embodiment showing the locking ledge.
FIG. 13 is a sectional end view of the frame of an embodiment showing the protective ledge.
Figure 14:
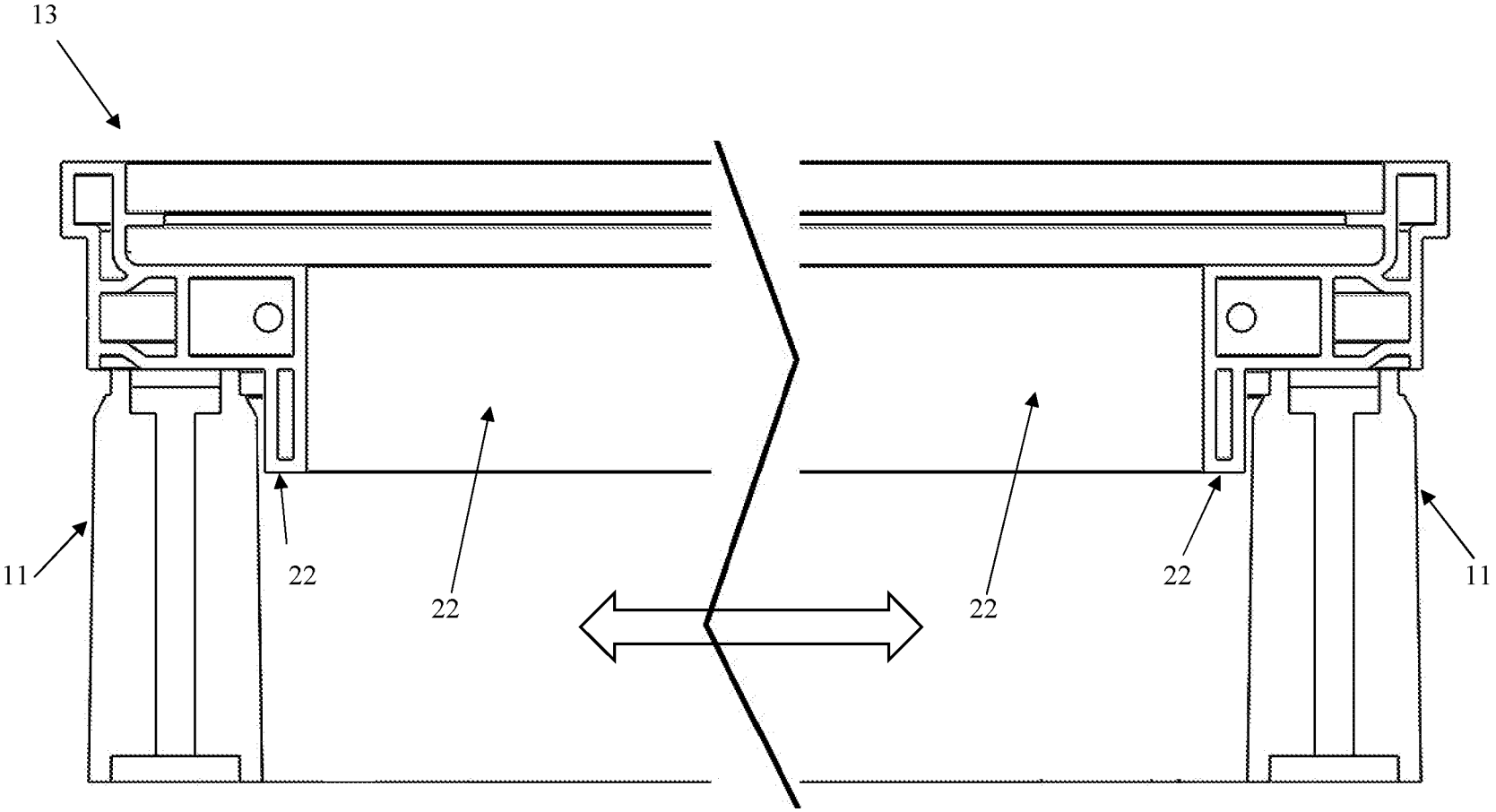
FIG. 14 is a sectional side view of the configuration of FIG. 1, showing the locating raising frame functionality.

As shown in FIG. 13, the outer wall 31 of the external upstand 23 will typically be spaced further outwardly to the external wall of the central body 26. This configuration will typically allow the outer wall 31 of the external upstand 23 to protect the central body 26 of the frame section from any contact. As will become clearer below, this configuration also creates a clearance for the head 35 of a bolt 32 provided to attach a beam pocket 33 for example relative to a side wall 34 of an opening into which the pit 10 is located.

The external upstand 23 may be provided with an upper wall 36 which is spaced above the cover support wall 21.

The upper wall 36 is spaced above the cover support wall 2 sufficiently such that the upper wall 36 is substantially coplanar with the top surface of one or more cover members 14 when the one or more cover members 14 is correctly fitted relative to the modular frame 12. The upper wall 36 will preferably be substantially planar and substantially horizontal in use.

The external upstand 23 has an inner wall 37. The inner wall 37 will typically be substantially vertical. The inner wall will typically be the portion of the upstand 23 which at least partially defines the opening for the cover member 14. The inner wall 37 will also typically provide an abutment wall for the outer edge of the cover member 14, should the cover member 14 be forced laterally within the modular frame 12 at any point. As shown in FIGS. 8 to 11, when the cover members 14 are fitted relative to the modular frame 12, a clearance or separation gap (X) will typically be provided between the inner wall 37 of the upstand 23 and the outer edge of the cover member 14 located adjacent thereto. In a preferred form, the cover member 14 will be spaced from the inner wall 37 (and from other cover members) by a fixed dimension X. In use, the cover members 14 will preferably be provided relative to the modular frame using a fixed dimension peripheral clearance or separation gap about each cover member 14 which will in turn provide increased clearance in multiples of dimension X depending on the number of cover members 14.

A flange 38 preferably extends transversely and inwardly from the preferred inner wall 37 of the external upstand 23. The flange 38 will typically function as a locking ledge in order to releasably lock one or more cover members 14 relative thereto. Typically, the flange/locking ledge 38 extends over the length of the frame section. In one possible configuration illustrated in the Figures, the cover member 14 has a stepped outer edge with a peripheral upper lip 39 extending further outwardly than a lower part 40 of the cover member 14. The locking ledge 38 will also preferably support the peripheral upper lip 39 of the cover member 14 thereon and the lower part 40 of the cover member 14 will typically be supported on the cover support wall 21 as shown in FIG. 12 in particular.

Figure 9:
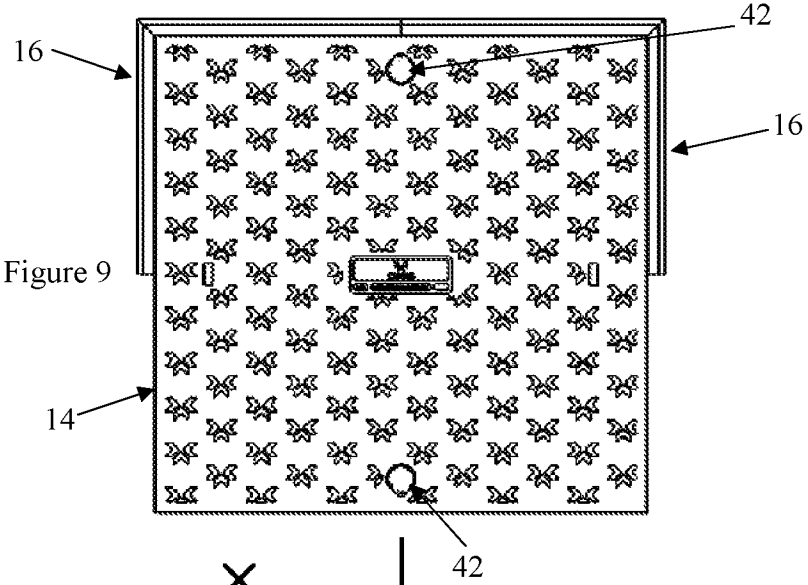
FIG. 9 is a top view of a cover tile of an embodiment.
Figure 11:
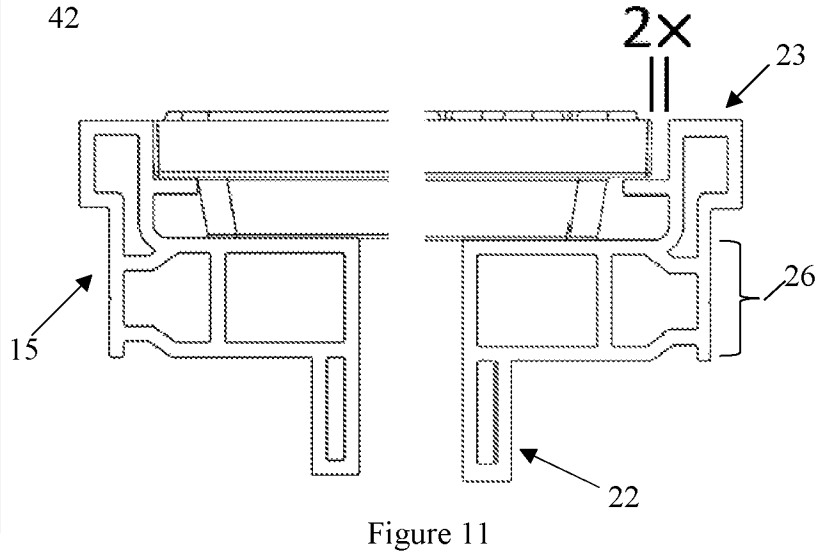
FIG. 11 is a side view of the cover tile of FIG. 9 pushed to one side with tolerance.
Figure 10:
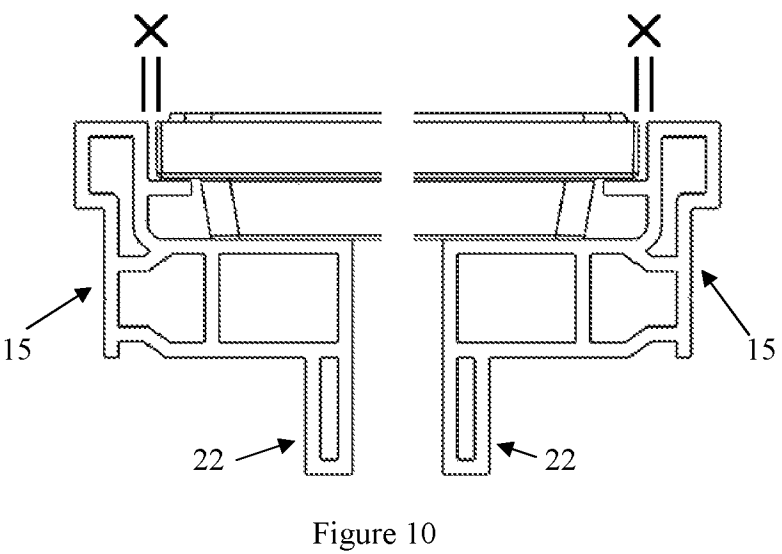
FIG. 10 is a side view of the cover tile of FIG. 9 in a central location with tolerance.

In the illustrated embodiments, the flange/locking ledge 38 is also used to engage a locking mechanism or structure provided on or relative to the cover member 14. This will typically assist with maintaining the cover members 14 relative to the modular frame 12 against vertical movement. For example as illustrated in FIG. 12 a laterally extending deformable cover attachment flap 41 may be provided on the cover member 14 and when the cover member 14 is installed relative to the modular frame 12, the deformable cover attachment flap 41 may abut an underside of the flange 38. As will be explained below, the cover member 14 may be provided with one or more rotatable locking members as shown in FIG. 9.

The flange 38 is spaced from the upper wall 36 of the external upstand 23 and from the cover support wall 21. Normally, the flange 38 is located approximately halfway between the upper wall 36 of the external upstand 23 and the cover support wall 21.

As mentioned above, the number of cover members 14 used will typically be a whole number (in other words, cover members will not be required to be cut to fit to the modular frame). The cover members 14 may have different dimensions, for example, half size cover members may be provided in order to maximise the configurations available, but the cover members 14 will preferably all have the same features allowing cover members 14 of different dimensions to be fitted relative to the modular frame 12 in any location.

Each cover member 14 will typically have a substantially planar upper support surface. The upper support surface may have gripping members or assemblies provided relative thereto as illustrated in FIG. 9. Each cover member 14 will preferably have a stepped side wall with a peripheral upper lip 39 extending further outwardly than a lower part 40 of the cover member 14. The peripheral upper lip 39 will typically extend completely about the cover member 14.

In one embodiment illustrated for example in FIG. 9, a pair of locking pins 42 may be provided relative to each cover member 14 in order to releasably lock the cover member 14 relative to the modular frame 12, particularly, the locking ledge 38. Each locking pin 42 will typically be rotatable between a locked position and an unlocked position. In the locked position, a portion of the locking pin 42 will preferably engage the locking ledge 38 of one of the frame sections and/or a beam 18 (explained further below). The provision of a pair of locking pins 42 will allow the cover member to be locked in position on two sides.

In an embodiment, the locking pin 42 will typically include an enlarged head, typically received within a rebate or recess in an upper surface of the cover member 14, an elongate shaft which extends through an opening in the cover member 14 and a locking flange provided relative to the shaft which, when rotated into the locked position, typically abuts the locking ledge 38 of the frame member and/or beam 18. Normally, the locking pin 42 is rotated to approximately 90° in order to lock and unlock the locking pin 42.

Figure 7:
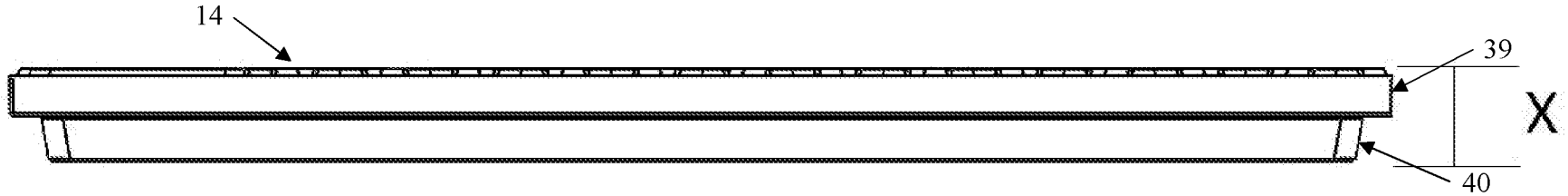
FIG. 7 is a side view of a cover tile according to an embodiment.
Figure 8:
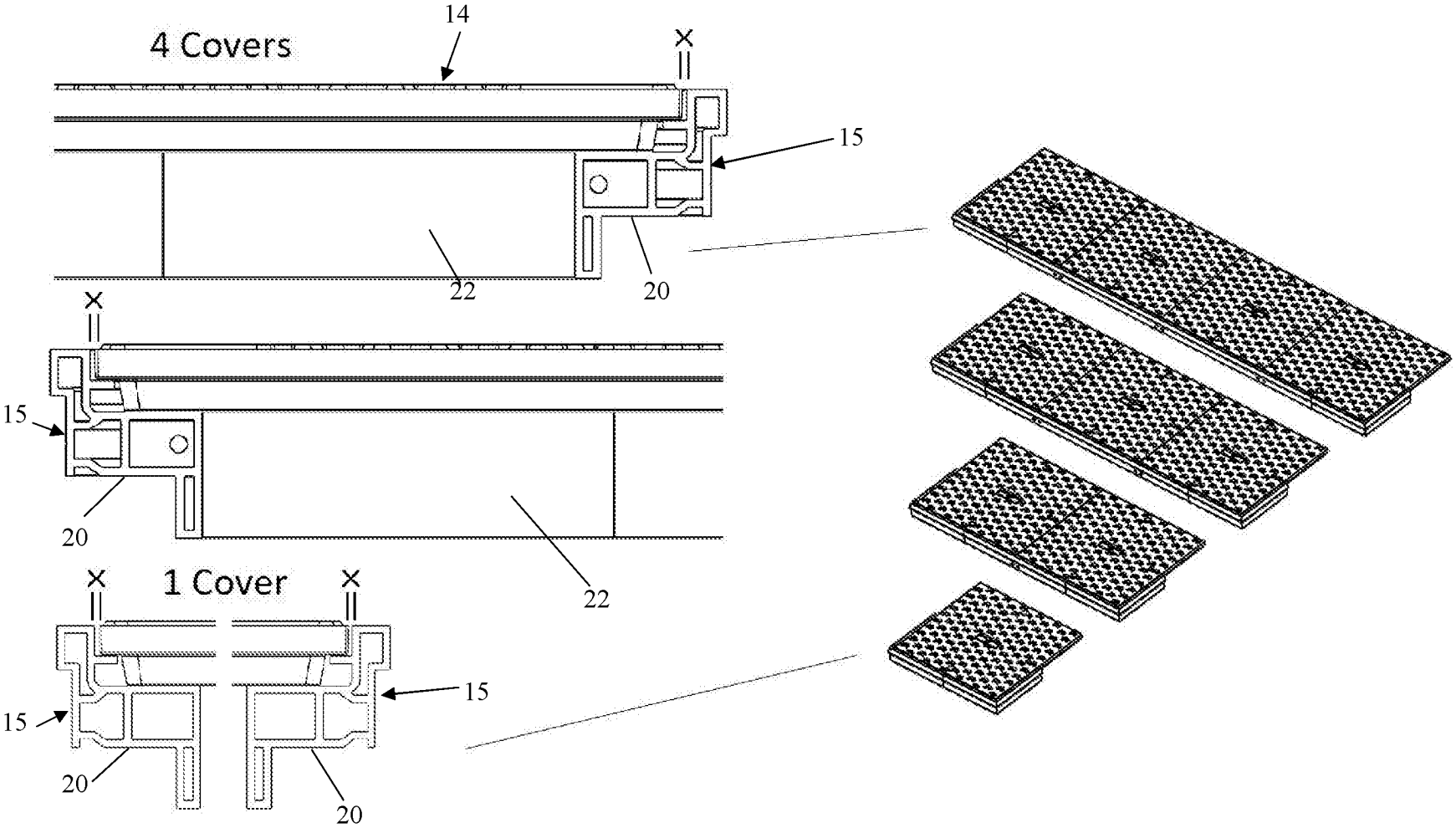
FIG. 8 is a set of side views showing the different cover configurations with side tolerance of an embodiment.

Each cover member 14 will typically be a fixed depth as shown in FIG. 7. The cover members will normally have the same configuration. Different cover members 14 may be manufactured of different materials in order to adjust the load rating of the cover member to suit different load applications. For example, a lighter weight plastic may be used for a cover member with a lower load rating and a metal cover member, having exactly the same features could be used for a higher load rating. The cover members of the lighter weight plastic and the metal cover member may be used in relation to the same frame section with the material used for the cover member adjusting the use characteristics.

The modular frame 12 may be provided with one or more transverse beams 18 as shown in FIG. 2 in order to support an edge of one or more cover members 14. The transverse beams 18 will typically be provided between opposite sides of the modular frame 12. A beam pocket 33 will typically be provided at both ends of each transverse beam 18 in order to locate and support the transverse beam 18 relative to the modular frame 12. The beam pocket 33 will typically be attached to the frame section. Preferably, the beam pocket 33 will be attached to the frame section using a releasable fastener such as an elongate bolt 32 or similar. Where provided, the elongate bolt 32 will typically extend laterally through the preferred central body 26 of the frame section. As mentioned above, where a bolt 32 is provided, the head 35 of the bolt 32 will typically be protected by the external upstand 23 such that the head 35 of the bolt 32 does not extend further laterally outside the external upstand 23.

Figure 18:
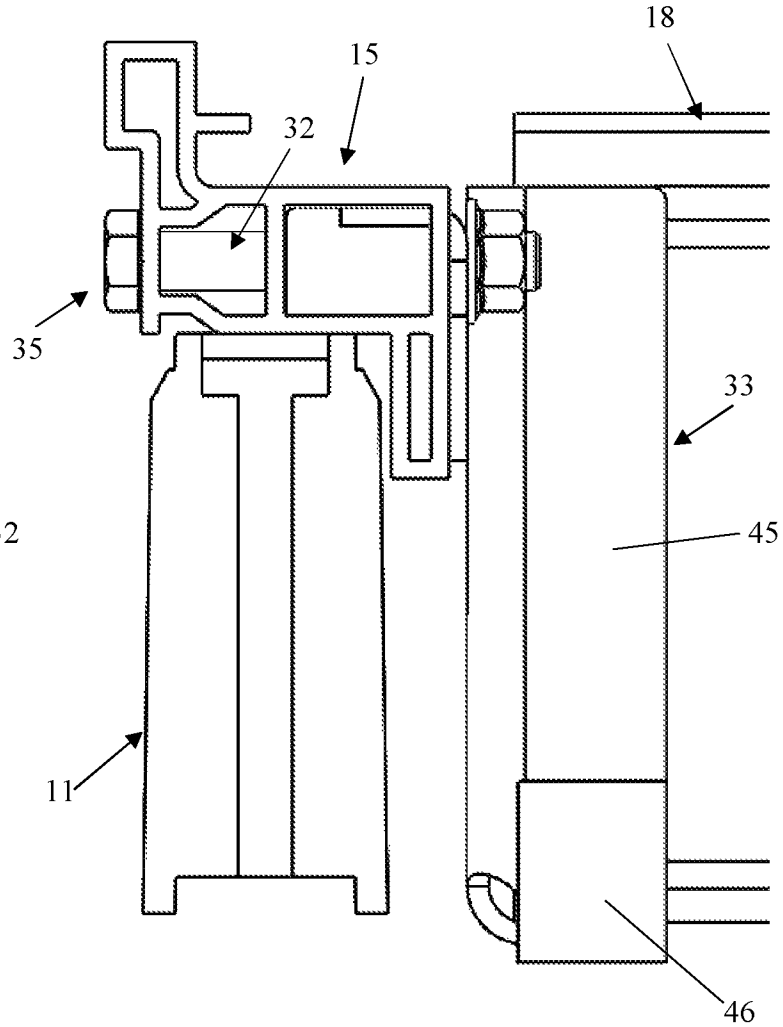
FIG. 18 is an end view of the configuration illustrated in FIG. 17.
Figure 17:
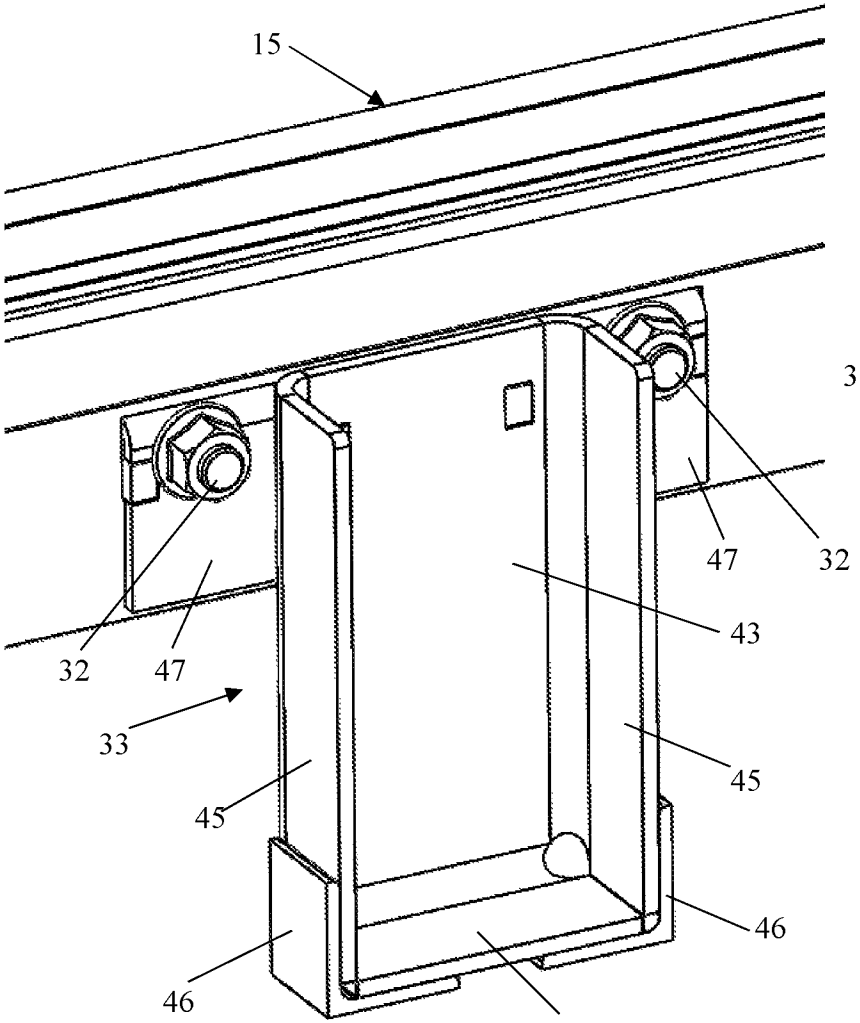
FIG. 17 is an axonometric view of a beam pocket attached to a frame member in an embodiment.

As shown in FIGS. 17 and 18, the beam pocket 33 of an embodiment will typically be substantially rectangular. The beam pocket 33 will normally include a planar rear wall 43 which is typically oriented substantially vertically in use. A transversely extending base flange 44 will preferably extend from or relative to the planar rear wall 43. The base flange 44 will typically abut a lower end portion of the beam 18 to support the beam 18. A pair of spaced apart side flanges 45 will preferably be provided. The side flanges 45 will preferably extend transversely from or relative to the base wall 44. Together with the base flange 44, the spaced apart side flanges 45 will preferably define a substantially U-shaped receiver portion into which the end of a beam 18 is received as shown in FIG. 18. The beam pocket 33 may be formed from a single piece of material which is bent or shaped to provide of the rear wall 43, base flange 44 and side flanges 45. Reinforcing sections 46 may be provided relative to the base flange 44 and each of the side flanges 45.

One or more attachment flanges 47 may be provided relative to the planar rear wall 43. The attachment flanges 47 will typically extend from the rear wall 43, on either side of the beam pocket 33 to provide fixing portions through which the preferred bolts 32 are provided to attach the beam pocket 33 relative to the frame section(s).

Each beam 18 will typically include a cover support wall 48. Typically, the cover support wall 48 of the beam 18 is substantially planar. A pair of cover support walls 48 are provided on either side of the central divider 49 extending over the length of the beam 18. The central divider 49 will typically assist with location of a cover member 14 relative to the beam 18.

The beam 18 may be attached to the beam pocket 33 if required or simply be received within the beam pocket 33 to locate the beam relative to the external frame 12.

Figure 20:
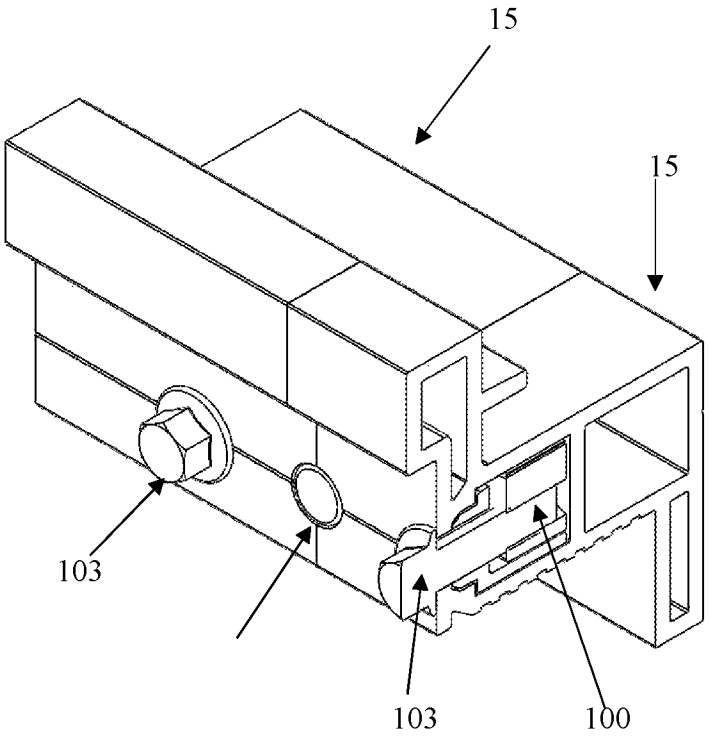
FIG. 20 is a sectional view of the configuration shown in FIG. 19 along line A-A.
Figure 19:
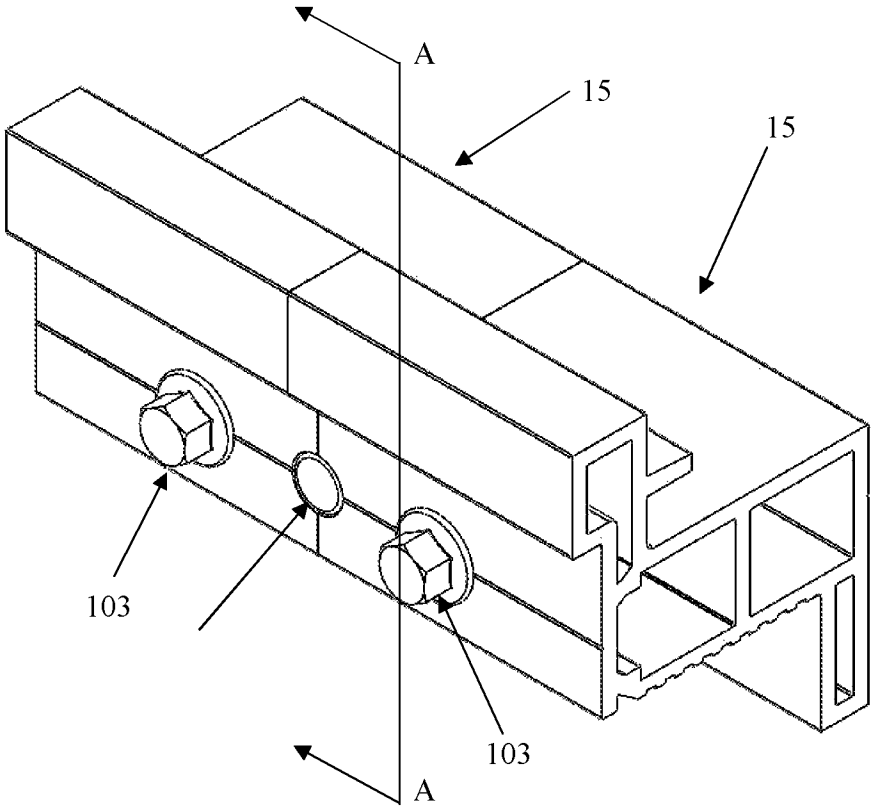
FIG. 19 is an isometric view of two adjacent frame members at a connection point in an embodiment.
Figure 22:
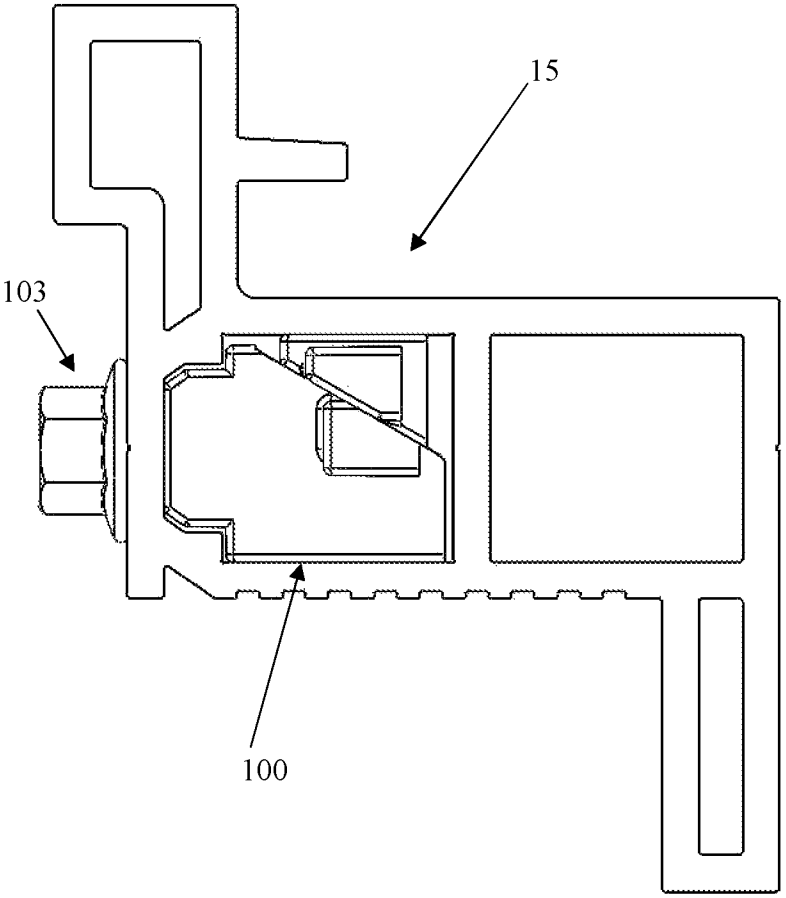
FIG. 22 is a sectional end view of the configuration illustrated in FIG. 19 with the connector block in the clamped condition.
Figure 21:
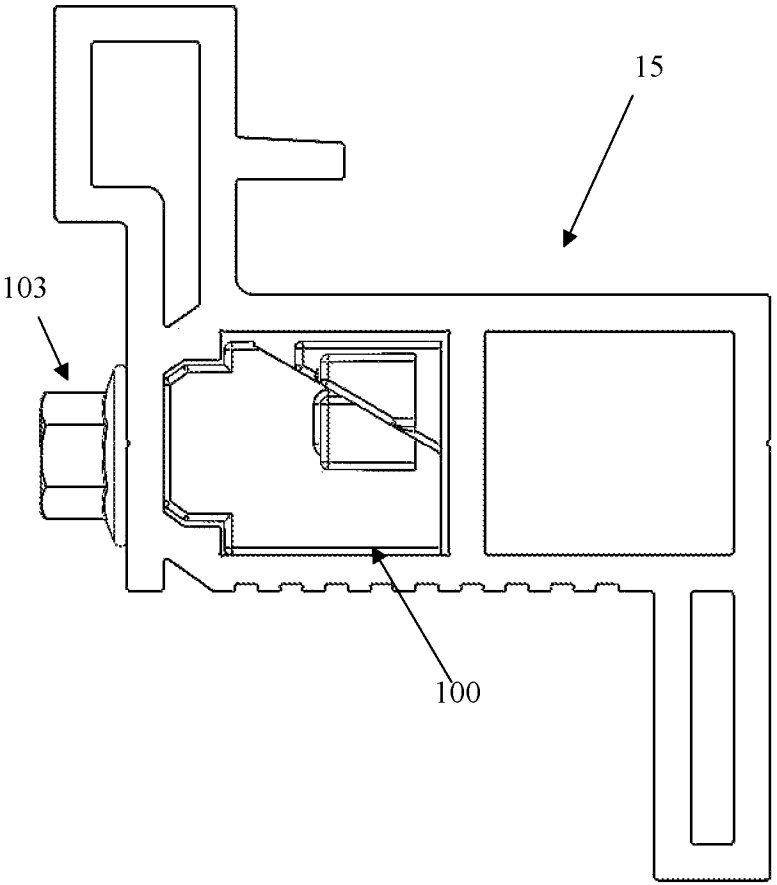
FIG. 21 is a sectional end view of the configuration illustrated in FIG. 19 with the connector block in the relaxed condition.
Figure 24:
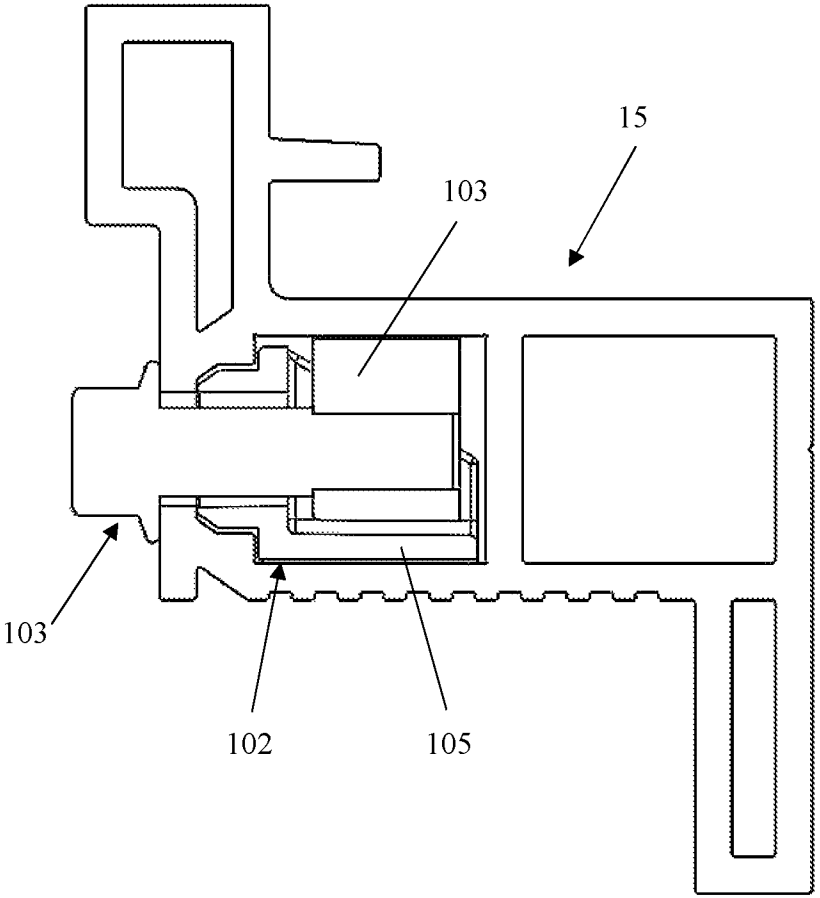
FIG. 24 is a sectional end view of the configuration illustrated in FIG. 20 with the connector block in the clamped condition.
Figure 23:
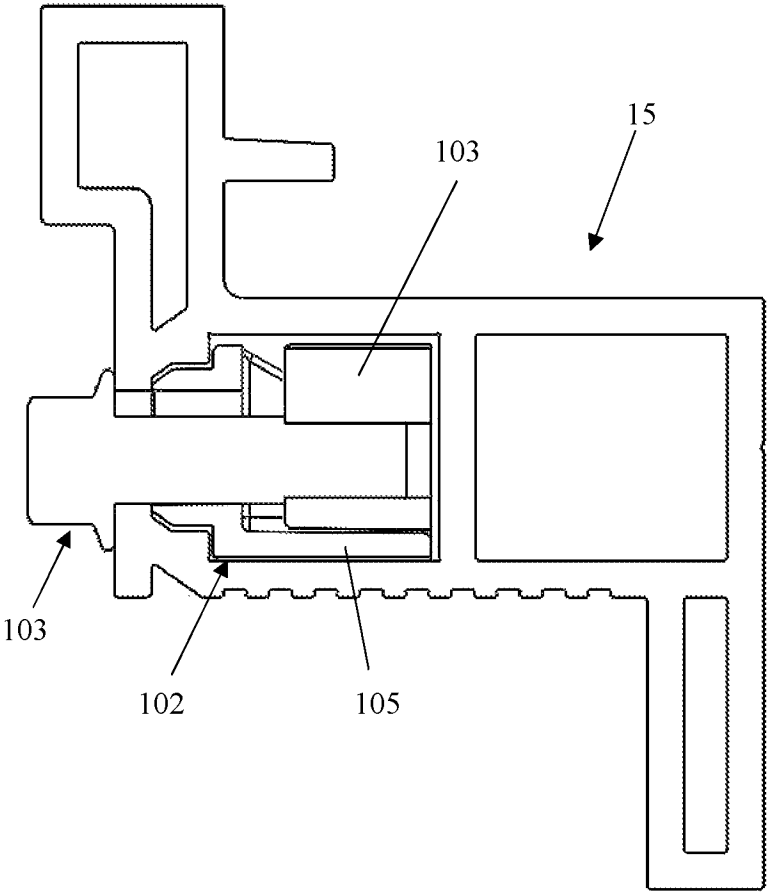
FIG. 23 is a sectional end view of the configuration illustrated in FIG. 20 with the connector block in the relaxed condition.

A connector block for connecting adjacent hollow frame sections or portions 15 together is illustrated in FIGS. 19 to 27. As shown in FIGS. 19 and 20, the respective frame portions 15 each have an opening (obscured by head of fastener 103) in a side wall thereof to receive the elongate fastener 103 therethrough. the connector block 100 illustrated in FIGS. 19 to 27 can be used in lieu of the connector block 24, illustrated in FIG. 15.

The connector block 101 in FIGS. 19 to 27 comprises a first connector block component 101 comprising an enlarged body portion 104 and a clamping portion 105, a pair of guide openings 106 for a respective elongate fastener 103, a main angled ramp portion 107 and a pair of secondary angled ramp portions 108. Each of the secondary angled ramp portions 108 are provided at least partially on a lug 114 provided at either end of the first connector block component 101.

The connector block 100 in FIGS. 19 to 27 also comprises a second connector block component 102 comprising a body portion 109 and a clamping portion 110, a pair of engagement openings 111 for a respective elongate fastener 103, a main angled ramp portion 112 and a pair of secondary angled ramp portions 113. Each of the secondary angled ramp portions 113 are provided at least partially on a lug 115 provided at either end of the second connector block component 102.

Figure 25:
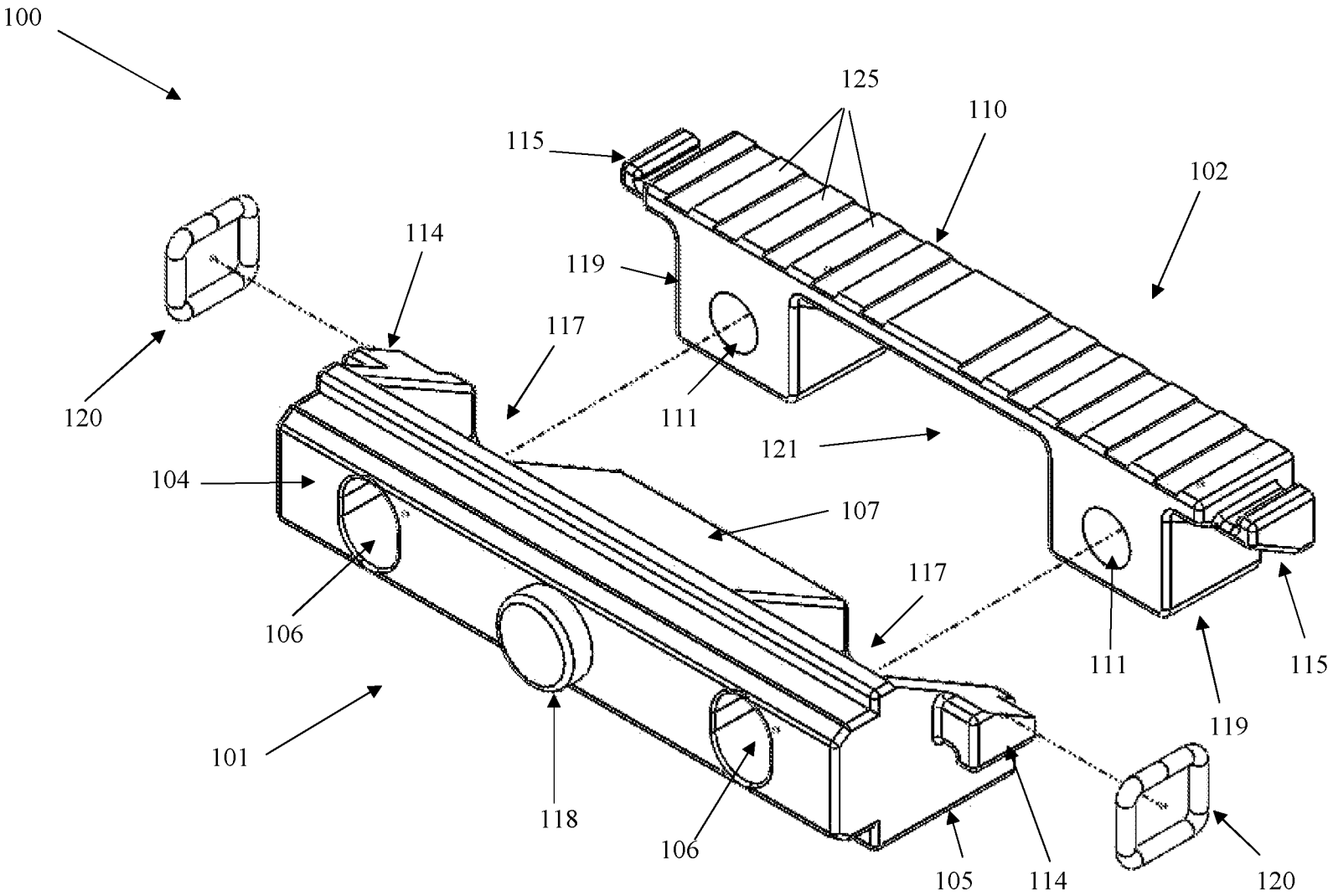
FIG. 25 is an axonometric exploded view of a connector block of an embodiment.
Figure 27:
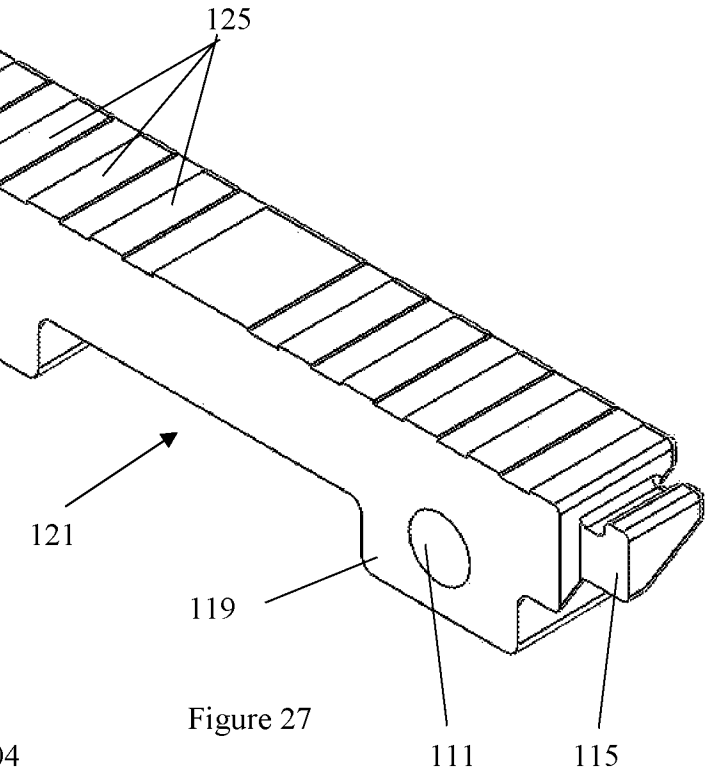
FIG. 27 is an axonometric view of the second connector block component from the side opposite to that shown in FIG. 25.
Figure 26:
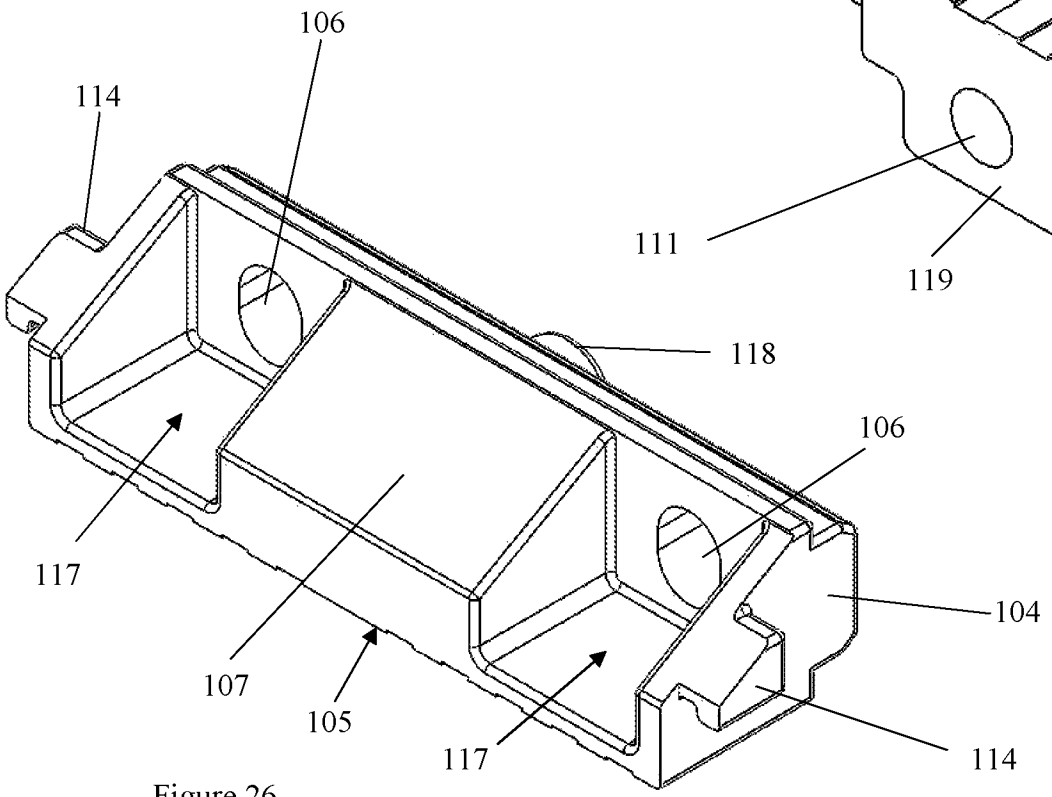
FIG. 26 is an axonometric view of the first connector block component from the side opposite to that shown in FIG. 25.

These components are best illustrated in FIGS. 25 to 27.

The first connector block component 101 and the second connector block component 102 are each provided in a single piece but could be multipiece to take advantage of different advantageous material properties. Both are generally rectangular in shape.

The first connector block component 101 includes an enlarged body portion 104 located adjacent to the head of the fastener 103 and a second portion extending substantially perpendicularly thereto. The enlarged body portion 104 shown in FIG. 25 is shaped to engage with one or more features of an internal shape of the frame portion 15 as shown in FIGS. 21 to 24. This engagement will usually strengthen the clamping engagement between the connector block 101 and the respective frame portions 15 by positively locating the first connector block component 101 (and thereby, the connector block 100) within the frame portion 15.

The guide openings 106 extend through the enlarged body portion 104. The clamping portion 105 is provided on the second portion extending substantially perpendicularly to the enlarged body portion 104.

The guide openings 106 extend substantially parallel to the clamping portion 105.

The clamping portion 105 of the first connector block component 101 illustrated in FIGS. 19 to 27 is provided on the lower part of the first connector block component 101. The clamping portion 110 is provided on the upper part of the second connector block component 102 with the respective ramp portions therebetween.

The clamping portion 105 is provided as a number of smaller fingers 125 (only the fingers on the second connector block component are illustrated but similar fingers are provided on 105), each with a clamping surface, and the surfaces being coplanar with each other. The clamping surfaces of each of the of smaller fingers 125 are coplanar. The fingers shown are parallel. The configuration of the clamping portion 105 of the first connector block component 101 in the illustrated embodiment is substantially the same as configuration of the clamping portion 110 of the second connector block component 102.

The first connector block component 101 includes a male, main angled ramp portion 107, centrally located on the first connector block component 101. The main angled ramp portion is provided between a pair of guide block opening 117. The main angled ramp portion 107 is provided on the opposite side of the enlarged body 104 to an alignment boss 118 and faces the second connector block component 102.

A pair of secondary angled clamp portions are provided, one on each end lug 114. The guide block opening 117 are defined between the main angled ramp portion 107 and end walls from which each of the lugs 114 extend.

As illustrated, the main angled ramp portion 107 and each of the end walls have parallel side walls to define the guide block opening 117. The base of the guide block opening 117 is also preferably planar. The base of the guide block opening 117 will normally be perpendicular to the sidewalls of the guide block opening 117 and the end walls of the guide block opening 117 to guide movement of the guide blocks 119 of the second connector block component 102 (described further below).

Each lug 114 is provided with a groove or groove portion at least partially about an outer part of the lug 114. The groove or groove portion seats a resilient loop 120. The resilient loop 120 acts to hold the first connector block component 101 and the second connector block component 102 together but still allow relative movement. The resilient loop 120 may also bias the first connector block component 101 and the second connector block component 102 into the relaxed condition.

An alignment boss 118 or protrusion is provided on an external side of the enlarged body portion 104. The alignment boss 118 is provided on the same wall of the enlarged body portion 104 as the guide openings 106. As seen in FIGS. 19 and 20, a corresponding opening portion is provided in the end edge of the frame portions 15.

The second connector block component 102 corresponds, at least on the facing surfaces, with the configuration of the first connector block component 101.

The main angled ramp portion 112 provided on the second connector block component 102 is a female main angled ramp portion provided in a receiving gap 121 on the second connector block component 102 to receive the male main angled ramp portion 107 provided on the first connector block component 101.

The receiving gap 121 on the second connector block component 102 is flanked by a guide block 119 on either side. Each guide block 119 has the engagement opening 111 formed thereinto.

Each of the guide blocks 119 is normally received into the respective guide block opening 117 on the first connector block component 101. At least a part of the outer shape of the guide blocks 119 correspond with the shape of the guide block opening 117.

As illustrated, the guide blocks 119 are each rectangular in outer shape, having a planar lower wall and a pair of parallel side walls. The guide block 119 is normally sized to be received closely within the guide block opening 117 of the first connector block component 101 to guide movement of the respective connector block components relative to one another.

As shown in FIGS. 19 to 24, the connector block 100 will normally be located with one end within a frame portion 15 and an opposite end within an adjacent frame portion 15 with the respective ends of the frame portions 15 abutting about the alignment boss 118 so that the connector block 100 is wholly within the two adjacent frame portions 15.

The connector block 101 will generally clamp the adjacent frame portions 15 together by frictionally engaging with both frame portions 15 preferably multiple internal surfaces of each frame portion 15.

The elongate fasteners 103 preferred for use will include an enlarged head and an elongate shank. The elongate shank will normally be at least partially threaded to engage with the correspondingly internally threaded portion of the engagement openings 111 of the second connector block component 102.

In use, the connector block 101 is located partially in the hollow end of a frame portion 15 and partially in a hollow end of an adjacent frame portion 15. The frame portions 15 are then pushed together until their respective end edges abut about the alignment block 118, completely containing the connector block 101. The fasteners 103 can then be inserted through the openings in the frame portions 15, through the guide openings 106 in the first connector block component 101 and into the engagement openings 111 in the second connector block component 102. When the fasteners 103 are tightened, this draws the second connector block component 102 towards the first connector block component 101 and the respective ramp portions cause the connector block 100 to become enlarged toward, and eventually into the enlarged clamping condition in which the clamping portions 105, 110 abut one or more inside wall surfaces of the respective frame portions 15 to clamp them each to the connector block 100 and through their mutual clamping to the connector block, connect the frame portions 15 relative to one another. Loosening the fasteners 105 may allow the biasing force of the resilient loops 121 to return the connector block components to the relaxed condition allowing disconnection of the frame portions 15.

The one or more embodiments are described above by way of example only. Many variations are possible without departing from the scope of protection afforded by the appended claims.

The invention claimed is:

1. A modular frame for a cover for an in-ground chamber or pit, the modular frame comprising:

a plurality of frame sections securable relative to one another to form an external frame defining a central opening for the cover, at least some of the frame sections comprising a hollow central body with an abutment wall to abut an upper portion of the in-ground chamber or pit;

a cover support structure to support a portion of one or more cover members thereon; and a depending structure to at least partially define an internal skirt configured to be received within the in-ground chamber or pit, wherein the abutment wall and the cover support structure are parallel and spaced apart.

2. A modular frame as claimed in claim 1 wherein frame sections are releasably securable relative to one another.

3. A modular frame as claimed in claim 1 wherein a connector block shaped to fit to at least partially within the hollow central body of respective frame sections is provided with a pair of perpendicular mechanical fasteners, each located through a portion of a pair of adjacent frame sections and through the connector block.

4. A modular frame as claimed in claim 1 wherein all of the frame sections used in the modular frame include the abutment wall, the cover support structure, the depending structure and an external upstand.

5. A modular frame as claimed in claim 1 wherein the depending structure extends substantially perpendicularly to the abutment wall.

6. A modular frame as claimed in claim 1 wherein each frame section comprises a central body with the abutment wall comprising a lower wall of the central body.

7. A modular frame as claimed in claim 6 wherein the cover support structure is provided at an upper side of the central body, spaced from the abutment wall.

8. A modular frame as claimed in claim 7 wherein the abutment wall and cover support structure are spaced apart by a pair of end walls.

9. A modular frame as claimed in claim 8 wherein one or more intermediate walls are provided between the abutment wall and the cover support structure and between the end walls.

10. A modular frame as claimed in claim 1 further comprising an external upstand to at least partially define an opening into which the one or more cover members are locatable to at least partially close the opening.

11. A modular frame as claimed in claim 10 wherein the external upstand comprises a substantially vertical outer wall with an overhang to provide clearance on an external side of the frame section.

12. A modular frame as claimed in claim 10 wherein the external upstand comprises an inner wall which at least partially defines the opening for the at least one cover member.

13. A modular frame as claimed in claim 10 further comprising a flange extending transversely and inwardly from the external upstand.

14. A modular frame as claimed in claim 13 wherein the flange engages a locking mechanism or structure provided on or relative to the cover member.

15. A modular frame as claimed in claim 1 further comprising at least one pair of beam pockets provided to support a transverse beam in order to locate and support the transverse beam relative to the modular frame wherein each beam pocket is attached to the frame section using a releasable fastener.

16. A cover assembly for an in-ground chamber or pit comprising the modular frame as claimed in claim 1 and at least one cover member.

17. The cover assembly as claimed in claim 16 wherein each cover member comprises a substantially planar upper support surface.

18. An in-ground chamber or pit including at least one wall assembly and a cover comprising the modular frame as claimed in claim 1.

19. A modular frame as claimed in claim 2 further comprising a connector block for connecting adjacent hollow frame portions together, the respective frame portions each having at least one opening in a side wall thereof to receive an elongate fastener therethrough, the connector block comprising:

a. a first connector block component comprising a body with a clamping portion, at least a pair of guide openings for a respective elongate fastener and at least one angled ramp portion;

b. a second connector block component comprising a body with a clamping portion, at least a pair of engagement openings for a respective elongate fastener and at least one angled ramp portion;

wherein elongate fasteners cause the respective angled ramp portions to slide relative to one another to move the respective clamping portions between a relaxed condition and an enlarged, clamping condition located with a first end of the connector block within a first frame portion and an opposite end of the connector block within an adjacent frame portion with the respective ends of the frame portions abutting so that the connector block is wholly within the two adjacent frame portions.

* * * * *